US006768265B1

(12) United States Patent
Ives et al.

(10) Patent No.: US 6,768,265 B1
(45) Date of Patent: Jul. 27, 2004

(54) ELECTRON GUN FOR MULTIPLE BEAM KLYSTRON USING MAGNETIC FOCUSING

(75) Inventors: R. Lawrence Ives, Saratoga, CA (US); George Miram, Atherton, CA (US); Anatoly Krasnykh, Santa Clara, CA (US)

(73) Assignee: Calabazas Creek Research, Inc., Saratoga, CA (US)

( * ) Notice: Subject to any disclaimer, the term of this patent is extended or adjusted under 35 U.S.C. 154(b) by 83 days.

(21) Appl. No.: 10/128,215

(22) Filed: Apr. 22, 2002

Related U.S. Application Data

(63) Continuation-in-part of application No. 09/629,364, filed on Aug. 1, 2000.

(51) Int. Cl.[7] ..... H01J 25/02
(52) U.S. Cl. ..... 315/5.16; 315/5.39; 713/414
(58) Field of Search ..... 315/5.16, 5.14, 315/5.29, 5.39, 5.51, 5.35, 3.5; 313/412, 414, 442

(56) References Cited

U.S. PATENT DOCUMENTS 4,137,482 A 1/1979 Caryotakis ..... 315/3.5
4,508,992 A 4/1985 Bohlen ..... 315/5.39
4,555,646 A * 11/1985 Miram et al. ..... 315/5.35
4,853,601 A * 8/1989 Odenthal ..... 315/368
5,838,107 A * 11/1998 Beunas et al. ..... 315/5.16
5,932,972 A 8/1999 Symons ..... 315/5.16

FOREIGN PATENT DOCUMENTS

WO WO 97/38436 10/1997

* cited by examiner

*Primary Examiner*—Don Wong
*Assistant Examiner*—Jimmy T. Vu
(74) *Attorney, Agent, or Firm*—Jay A. Chesavage

(57) ABSTRACT

An RF device comprising a plurality of drift tubes, each drift tube having a plurality of gaps defining resonant cavities, is immersed in an axial magnetic field. RF energy is introduced at an input RF port at one of these resonant cavities and collected at an output RF port at a different RF cavity. A plurality of electron beams passes through these drift tubes, and each electron beam has an individual magnetic shaping applied which enables confined beam transport through the drift tubes.

45 Claims, 19 Drawing Sheets

Brillouin Focused
Prior Art

Confined Flow
Prior Art

141

Section A–A

Section B–B

Section C–C

Section D–D

Section E–E

Section H–H

Section F–F

Section G–G

Separate Bunching Resonators

Section D–D

Section D–D

ELECTRON GUN FOR MULTIPLE BEAM KLYSTRON USING MAGNETIC FOCUSING

This application is a continuation-in-part of pending application Ser. No. 09/629,364 filed on Aug. 1, 2000.

FIELD OF THE INVENTION

The present invention relates to linear beam electron devices, and more particularly, to an electron gun that provides multiple convergent electron beamlets suitable for use in a multiple beam klystron using confined flow magnetic focusing.

BACKGROUND OF THE INVENTION

Linear beam electron devices are used in sophisticated communication and radar systems that require amplification of a radio frequency (RF) or microwave electromagnetic signal. A conventional klystron is an example of a linear beam electron device used as a microwave amplifier. In a klystron, an electron beam is formed by applying a voltage. potential between a cathode emitting electrons and an anode accelerating these emitted electrons such that the cathode is at a more negative voltage with respect to the anode. The electrons originating at the cathode of an electron gun are thereafter caused to propagate through a drift tube, also called a beam tunnel, comprising an equipotential surface, thereby eliminating the accelerating force of the applied DC voltage. The drift tube includes a number of gaps that define resonant cavities of the klystron. The electron beam is velocity modulated by an RF input signal introduced into the first resonant cavity. The velocity modulation of the electron beam results in electron bunching due to electrons that have had their velocity increased gradually overtaking those that have been slowed. Velocity modulation in the gain section of the tube leads to bunching, i.e. the transformation of the electron beam from continuously flowing charges to discrete clumps of charges moving at the velocity imparted by the beam voltage. The beam bunches arrive at the bunching cavity, sometimes called the penultimate cavity, where they induce a fairly high RF potential. This potential acts back on the beam, and serves to tighten the bunch. When the bunches arrive at the output cavity they encounter an even higher rf potential, comparable to the beam voltage, which decelerates them and causes them to give up their kinetic energy. This is converted to electromagnetic energy and is conducted to a load. The tighter the bunching, the higher the efficiency. However, a high degree of space charge concentration interferes with the bunching process and the efficiency. Other things being equal, the higher the perveance of a klystron, the lower the efficiency.

The effect of perveance on the gain of a klystron is different. Although the gain is affected by space charge, it is a stronger function of the total current, which is proportional to the perveance. This suggest that if a beam cross-section were made larger, so that the current density and space charge are reduced, both gain and efficiency would benefit. However, such is not the case because a large beam requires a large drift tube, and the electric fields which couple the beam to the circuit fall off across the beam, leading to poor coupling and a drop in both gain and efficiency. A small beam is therefore necessary, but if the power output required is high, the voltage, rather than the current in the beam must be increased for reasonable efficiency.

Bandwidth is inversely proportional to the loaded Qs of the klystron cavities. In the gain section of the tube, where cavities are stagger-tuned, the cavity Qs are loaded by the beam. The higher the current, the higher the loading, and consequently the lower the Q. It does not matter if a single beam or several beams are traversing the cavity. The output cavity, in particular, must by itself have a bandwidth at least equal to the desired bandwidth of the klystron. For the output cavity to produce good efficiency, this bandwidth becomes proportional to the beam conductance. However this leads to higher perveances, and hence lower efficiency. Consequently, in a single beam klstron the efficiency/bandwidth product is approximately constant.

Given the preceding relationships, the advantage of the multiple beam klystron provides is clear. The current is divided into several beams, each with a low space charge, so that it can be bunched tightly in a small drift tube with good coupling coefficient, and hence high efficiency. The gain-bandwidth product is not constant, but increases with the addition of beams. For the same power and gain, the multiple beam klystron is shorter than a conventional klystron.

Despite the potential advantages of multiple beam klystrons, such devices have only been adapted for certain low power or low frequency applications in which a convergent electron beam is not necessary. In these nonconvergent devices, electron beam focusing is provided by immersing the electron gun and drift tubes in a strong magnetic field which guides the electrons along the magnetic flux lines to the drift tubes. In a nonconvergent electron gun, the diameter of the emitting surface is the same as the electron beam that propagates through the RF device. The nonconvergent electron beams of this class of device have limited current density, which prevent them from developing more power at higher frequencies. The amount of current that can be emitted from the cathode is dependent on the size of the emitting surface and the maximum electron emission density that can be provided by the surface. Maximum electron emission densities from typical cathodes operating in the space charge limited regime are on the order of 10–20 amps/cm^2.

In a convergent electron gun, the cathode diameter exceeds the diameter of the final electron beam, which means that more current can be provided. The current gain is proportional to the area compression factor of the gun, which is the ratio of the cathode area to the cross sectional area of the final electron beam. Typical compression factors are 5–20.

Electron beams used for linear RF devices typically employ one of two types of magnetic focusing, which act in addition to the initial electrostatic focusing of a Pierce electron gun, whereby a stream of emitted electrons is initially focused to a region of minimum beam diameter. The first type of magnetic focusing is Brillouin focusing, where the magnitude of the magnetic field in the circuit section of the device precisely balances the space charge repulsion forces within the static beam. An embodiment of such a device is shown in FIG. 1. Electrostatic focusing is used to guide the electron beam from the cathode emitting surface to a point within the anode beam tunnel. A minimum diameter is achieved, and if a counteracting magnetic field were not applied, the beam would begin to diverge due to space charge forces. In Brillouin magnetically focused devices, an axial magnetic field is imposed at the location of the minimum diameter that balances the space charge forces and facilitates transport of the beam through the device.

Unfortunately, the balance between the space charge force tending to expand the beam and the magnetic force tending to confine the beam is no longer equal when electrostatic bunching of electrons occurs, as is required to transform beam power into RF power. Consequently, the beam will expand in regions of high electron density, eventually resulting in impact of electrons with the walls of the beam tunnel. This can result in destruction of the device unless the power deposited is limited. Therefore, Brillouin focused devices are limited in the average RF power and pulse lengths that can be generated.

The alternative is to use convergent, confined flow focusing, as shown in FIG. 2. With confined flow focusing, the magnetic field encompasses the cathode regions of the device where the electron beam is generated. A combination of magnetic and electrostatic focusing is used to guide the electron beam from the cathode into the beam tunnel. With confined flow focusing, the magnetic field can be higher than is required for balancing the space charge forces in the static beam. In typical devices, the magnetic field is 2–3 times the Brillouin value. With confined flow focusing, the convergent electron beam will be contained as it traverses the beam tunnel, even in the presence of electron bunching as used to generate RF power. Consequently, confined flow focused devices are capable of high average power operation.

In typical single beam devices, the magnetic field is generated from a solenoid or permanent magnet symmetrically located with respect to the electron beam, which produces a magnetic field that is radially symmetric about the electron beam, which is typically located on the main axis of the device. This radially symmetric field is necessary for the electron beam to follow its non-divergent axial path. The magnitude and shape of the field in the cathode-anode region is controlled using an iron enclosure around the main solenoid or permanent magnet with an aperture through end plates perpendicular to the device axis, allowing field penetration into the cathode-anode region. Auxiliary coils or permanent magnets may also be used in the cathode-anode region to control the shape and magnitude of the field.

While this works well for single beam devices having a beam tunnel symmetrically located with respect to the magnetic field axis, problems occur for electron guns where the cathode-anode region is radially displaced from the device axis. A radial gradient, or shear, in the magnetic field in the cathode-anode region distorts the magnetic focusing, preventing operation of the device. In order to realize a multiple beam device, it is necessary for most cathode-anode structures to be radially displaced from the device axis.

In light of these limitations, the need for a high power, multiple beam klystrons with confined flow focusing for use with high frequency RF sources is clear.

RELATED ART

A device described by Symons [U.S. Pat. No. 5,932,972] provides for a convergent multiple beam gun having a single cathode, a first plurality of conductive grids, a second plurality of drift tubes further containing resonant gaps, and an anode. The first plurality of conductive grids are spaced between the cathode and drift tubes, and contain apertures in locations such that electron beamlets are formed and defined by electrons traveling from the cathode, through the apertures in each of the grids, and into the drift tubes. Each of the grids has these apertures in substantial registration with each other and with respective openings of the plurality of drift tubes.

Symons relies on a plurality of grids to shape the electric potentials to focus the individual beamlets into the respective drift tunnels. In one embodiment of the invention, four separate grids are required to provide the necessary electric field configuration. Ceramic insulators providing a portion of the vacuum envelope of the device must electrically isolate each grid. In addition, a separate voltage is required for each grid.

The device described by Symons does not provide for confined flow focusing, as it can be seen that no magnetic focusing field is applied, and beam focusing is performed entirely by electrostatic potentials applied to the many grids. Consequently, the beam will not be fully confined in the presence of space charge bunching, limiting the average and peak power capability of the device. Further, the device described by Symons applies only to fundamental mode cavities, which limits the frequency at which this technique can be applied.

As the RF frequency increases, the available space for multiple beams through a fundamental mode cavity decreases in proportion to the increase in frequency. Consequently, the number of beams that can propagate through a fundamental mode cavity becomes limited by mechanical and thermal constraints. An alternative is to use a ring resonator circuit as described by Bohlen (U.S. Pat. No. 4,508,992). With a ring resonator circuit, the number of beamlets is not strictly limited by frequency considerations. Bohlen describes a microwave amplifier having an annular cathode, an annular ring resonator for the introduction of RF energy, an annular ring resonator for the removal of RF energy, and an annular collector, all of which are operating in the presence of a magnetic field. This structure enables reduced current densities and the application and collection of RF energy over a large physical area. A disadvantage of this structure is that the annular beam tunnels can allow transmission of higher order cavity modes back toward the electron gun. These modes can lead to undesired bunching of the electron beam and prevent operation at the desired frequency and power. Consequently, the gain of this device is limited to less than 25, and the output power level is limited to a few megawatts.

A multiple beam device using periodic permanent magnet focusing was described by Caryotakis et al (European patent WO 97/38436). This device uses periodic permanent magnet (ppm) focusing. PPM focusing uses an array of permanent magnets with alternating magnetic orientations to produce a focusing magnetic field. The focusing field produced by PPM focusing is axial, as in solenoidal focusing, but alternates direction, unlike solenoidal focusing. PPM focusing has been used for years for beam focusing in traveling wave tubes. The focusing described by Caryotakis only applies to beam confinement within the body or circuit section of the device and is not applicable to the electron gun region. Further it requires a series of cylindrical permanent magnets around each individual beam tunnel. Since these magnets can not tolerate high temperatures, they must be applied after construction of the vacuum envelope of the rf device. High power operation of rf devices requires processing in ovens operated at 400–500 degrees C. in order to obtain sufficient vacuum for operation. Consequently, each beam tunnel must contain its own individual vacuum envelope to provide access for the PPM magnets.

Since the device proposed by Caryotakis does not address the magnetic focusing in the electron gun, the present invention could be adapted to work in conjunction with the device described by Caryotakis.

SUMMARY OF THE INVENTION

In view of the limitations of the prior art, the present invention provides for an RF device having convergent multiple beams for use in high frequency, high power RF generators, such as multiple beam klystrons or inductive output tubes (IOT). This device has a plurality of drift tubes for the transport of multiple convergent beamlets in a rectilinear flow. Each drift tube carries an electron beam formed by an individual electron gun, and a plurality of these electron guns is arranged in a circular ring, with each electron gun providing a beam for use by an associated drift tube. Each electron gun has a cathode, an electrostatic focusing electrode and anode structure. The path of the confined flow of electrons from each electron gun through the drift tubes of the device forms a beam tunnel, and each separate gun has its own separate beam tunnel. Gaps between drift tubes form resonant cavities for the introduction and removal of RF power and for increased bunching of the electron beam. The RF power introduced into an input port of the device operates on each individual beamlet traveling through each individual beam tunnel, and RF power extracted at the output port is summed by the RF output structure. In the context of the present device, a high power composite electron beam is formed which comprises the contribution of each individual beamlet, so the output power of the device is limited only by the number of beamlets that are contributing to the RF output port. While the-beamlets formed by each electron gun travel through separate beam tunnels, the anode structure and cathode structure for each gun may be separate, or it may be shared.

In one embodiment of the invention, the beam tunnels for each electron beam include drift tubes having a first resonant cavity defined by a first gap provided in the plurality of drift tubes, and a second resonant cavity defined by a second gap provided in the plurality of drift tubes. An electromagnetic signal is coupled into an RF input port to the first resonant cavity, which velocity modulates the beamlets traveling in the plurality of drift tubes. The velocity modulated beamlets then induce an electromagnetic signal into the second resonant cavity, which may then be extracted from the device RF output port as a high power microwave signal. Other resonant cavities may also be applied between the first and final resonant cavity to increase the gain, bandwidth and efficieny of the device. A collector is disposed at respective ends of the plurality of drift tubes, which collects the remaining energy of the beamlets after passing across the various cavities. A magnetic field oriented coaxially to the beam tunnel is furnished to provide confined flow of the electron beam.

OBJECTS OF THE INVENTION

A first object of the invention is a multiple beam device for the amplification of Rf power having a plurality of electron beam tunnels, each said tunnel carrying an electron beam formed by an electron gun. The multiple beam device consists of the following elements:

- a plurality of drift tubes, the drift tubes separated to form a plurality of gaps associated with resonant cavities, including a first gap for the introduction of RF energy through an RF input port, and a final gap for the removal of RF energy through an RF output port,
- an anode for the acceleration of electrons,
- a magnetic field generator producing a radially symmetric field along a common axis defined by the beam tunnels,
- and a plurality of magnetic field correctors for producing a magnetic field which is radially symmetric through each individual beam tunnel.

A second object of the invention is a multiple beam device having a plurality n of electron guns, each electron gun providing an electron beam traveling through an electron beam tunnel between a cathode and a beam collector, a common magnetic field applied to the beams of all n electron guns, individual magnetic field correctors applied to each individual gun, an RF input port, and an RF output port.

A third object of the invention is a multiple beam device having an input RF port and an output RF port common to all electron beamlets. "A fourth object of the invention is a magnetic field correcter for an electron gun for a multi-beam klystron. A fifth object of the invention is a magnetic circuit comprising a magnetic field enclosure having a a central axis and end caps, a magnetic field generator inside this magnetic field enclosure, a plurality of beam tunnels located in the magnetic field enclosure, the beam tunnels coupled to a plurality of thermionic cathodes located external to the magnetic field enclosure and coupled to the beam tunnels through a plurality of apertures in the end caps, a magnetic field corrector to ensure the magnetic flux is perpendicular to the surface of the each cathode of the magnetic circuit, and an RF circuit which is coupled to the plurality of beam tunnels.

A sixth object of the invention is a magnetic field corrector comprising an end cap with plurality of apertures, each aperture comprising a first aperture for a beam tunnel and a second crescent aperture for magnetic field correction."

BRIEF DESCRIPTION OF THE DRAWINGS

FIG. 4-1, detail shows the detail of a beam tunnel having drift tubes and resonant gaps.

DETAILED DESCRIPTION OF THE INVENTION

Figure 1:
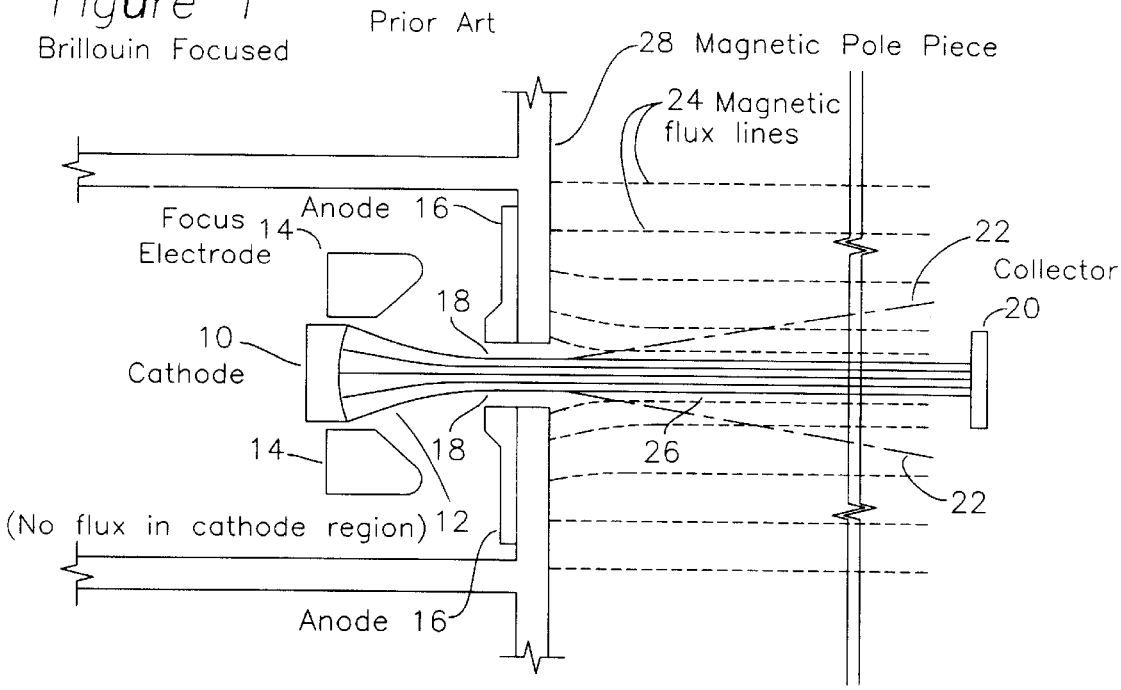
FIG. 1 is a schematic of a prior art Brillouin focused electron gun.

FIG. 1 shows a prior art Brillouin focused electron gun. A cathode 10 provides a flow of electrons 12 past an anode 16 at a positive voltage with respect to the cathode to a distant collector 20. In a Pierce gun, focus electrode 14 shapes the electron beam to a region of minimum beam diameter 18. Without a magnetic field, the self-charge of the electron beam causes beam spreading due to the space charge effect as shown in the trajectory 22. In Brillouin focusing, a magnetic field 24 is added which is coaxial to the beam 12, and of sufficient magnitude to cancel the space charge spreading, which results in the constant width beam 26, as shown. This magnetic field 24 may be provided through the introduction of electromagnetic coils or permanent magnet material and magnetic pole piece 28.

Figure 2:
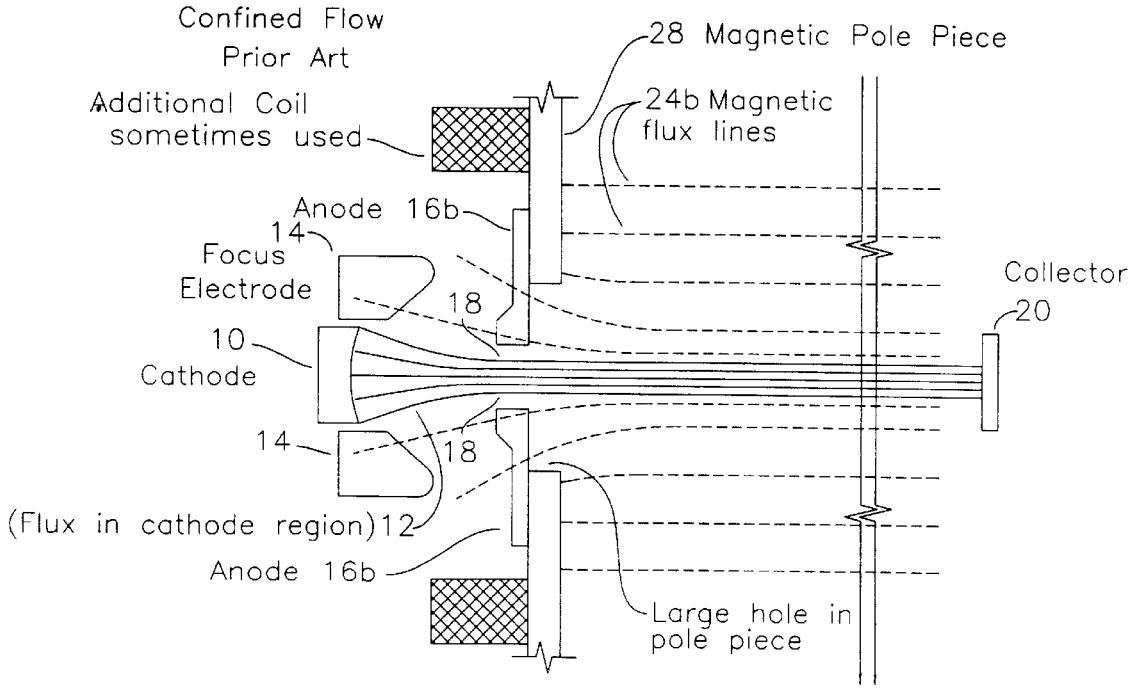
FIG. 2 is a schematic of a prior art confined flow electron gun.

FIG. 2 shows a prior art confined flow electron gun. As before, a Pierce gun comprising cathode 10 and focus electrode 14 produces an electron beam 12, which converges to a region of minimum diameter 18, after passing anode 16*b*. The coaxial magnetic flux field 24*b* is provided that is allowed to pass through the polepiece 28 and extend to the cathode, which provides a confined flow of electrons to the distant collector 20. The extension of the magnetic flux field to the cathode allows for an increase in the magnetic field greater than that necessary for precisely balancing the space charge forces in the unbunched beam.

Figure 3:
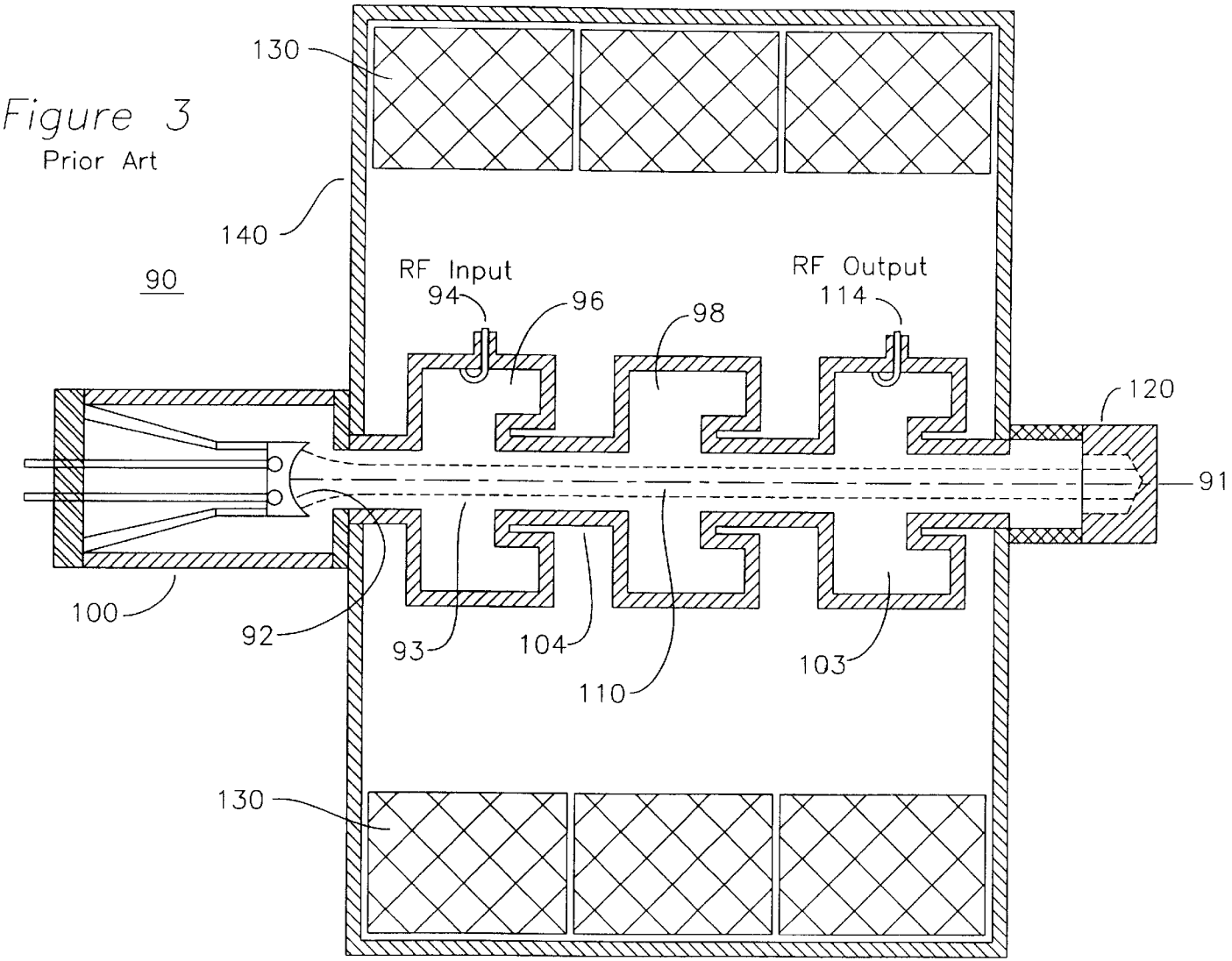
Figure 3 Prior Art
FIG. 3 is a section view of a prior art single beam klystron with a magnetic circuit.

FIG. 3 shows a prior art single beam klystron tube 90. Electron gun 100 provides a beam of initially focused electrons 92, which travel through a beam tunnel 93 to collector 120. The beam tunnel 93 is enclosed by electromagnet 130, which produces a coaxial magnetic flux field with flux lines parallel to the beam axis 91 and beam tunnel 93 within the iron enclosure 140. An RF input port 94 couples incoming RF energy to a resonant cavity 96, which velocity modulates the beam 110. A second resonant cavity 98 provides additional modulation, and a third cavity 103 enables the removal of RF energy through RF output port 114.

Figure 4:
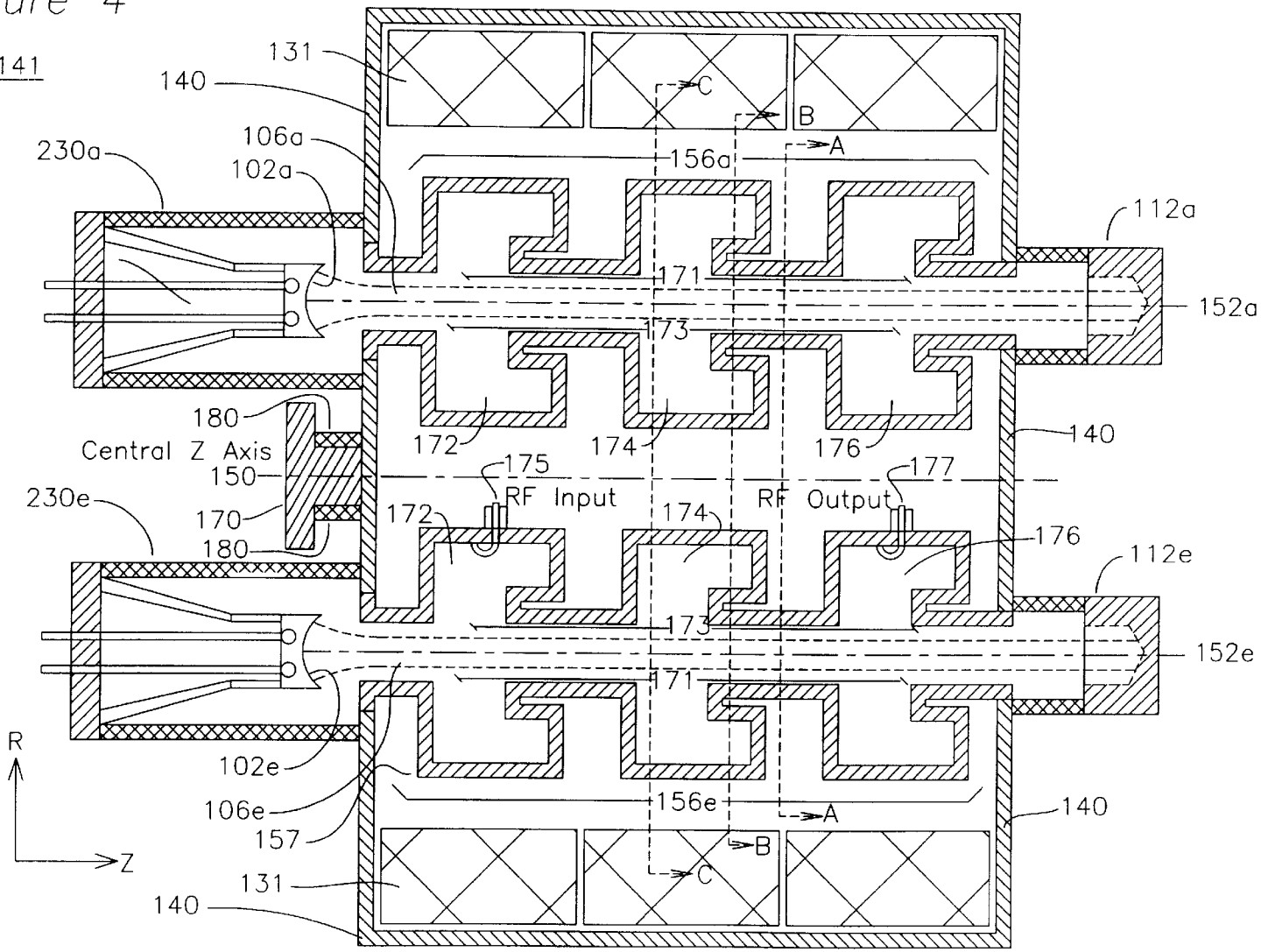
FIG. 4 is a section view of a multiple beam klystron showing individual electron guns creating a multiplicity of beamlets. Also shown is the magnetic circuit for focusing of the individual convergent multiple beams.
Figures 1, 4:
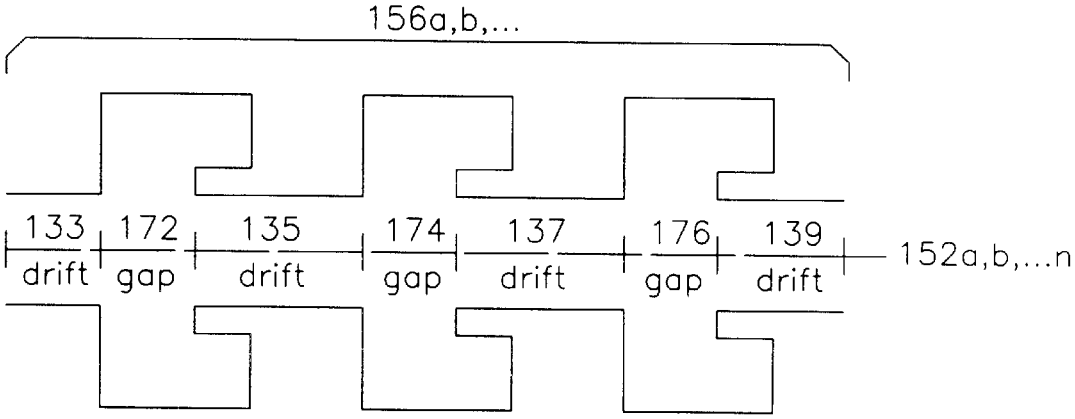

FIG. 4 shows the present invention, which provides a convergent multiple beam klystron 141 having a plurality of high current electron beams to permit construction of a multiple beam RF device of high power and high frequency. While the development of symmetric fields for radially symmetric devices is simplified by the intrinsic symmetry of the magnetic structures, this is not the case for multiple gun, off-axis designs such as the present invention of FIG. 4. As known in the art, conventional electron guns are designed using advanced computational tools to model the electrostatic potential, magnet flux contours, and electron trajectories. Examples of these codes include Maxwell 2D and Beam Optics Analysis (BOA) from Ansoft Corporation, the three dimensional finite difference program MAFIA, and the beam trajectory code XGUN. These tools were used to model the present invention to insure that laminar electrons beams were generated suitable for a klystron or IOT RF circuit. It is clear to one skilled in the art that magnetic field design tools of this type are required for the optimization of specific structures for use in shaping a magnetic field in the present art of designing confining flow magnetic fields for use in electron beam devices. For the present invention, Maxwell 2D and MAFIA were used to design a magnetic configuration where lines of magnetic flux intersect each cathode perpendicular to the emitting surface with sufficient magnitude to guide the electrons through the cathode-anode region into the center of each beamlet's respective beam tunnel. Maxwell 2D was also used to design the electrostatic geometry providing equipotential contours consistent with the desired operation. BOA and XGUN were used to model electron trajectories through the cathode-anode region to insure that the desired performance was achieved.

Figure 4A:
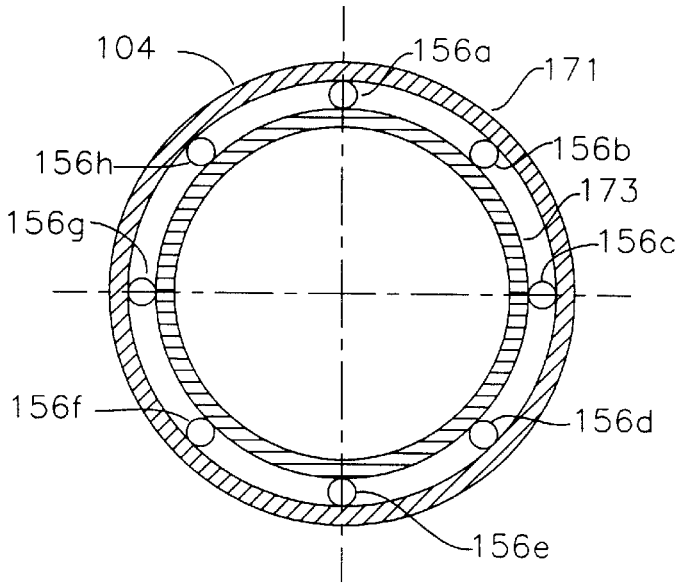
FIGS. 4*a* through 4*c* is are sections a—a, b—b, and c—c through FIG. 4.
Figure 4B:
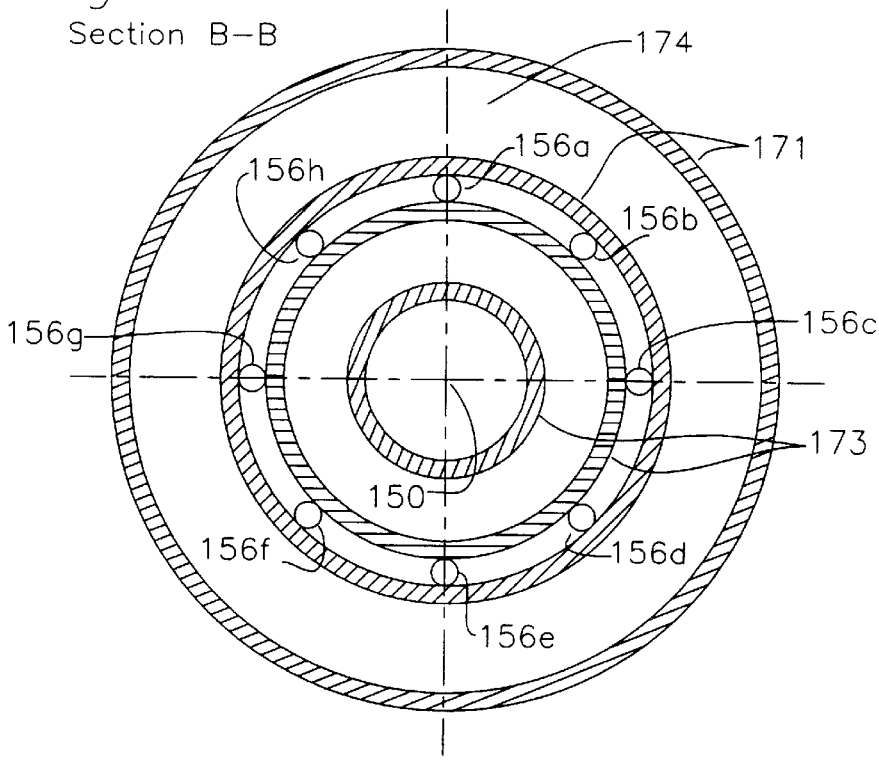
Figure 4C:
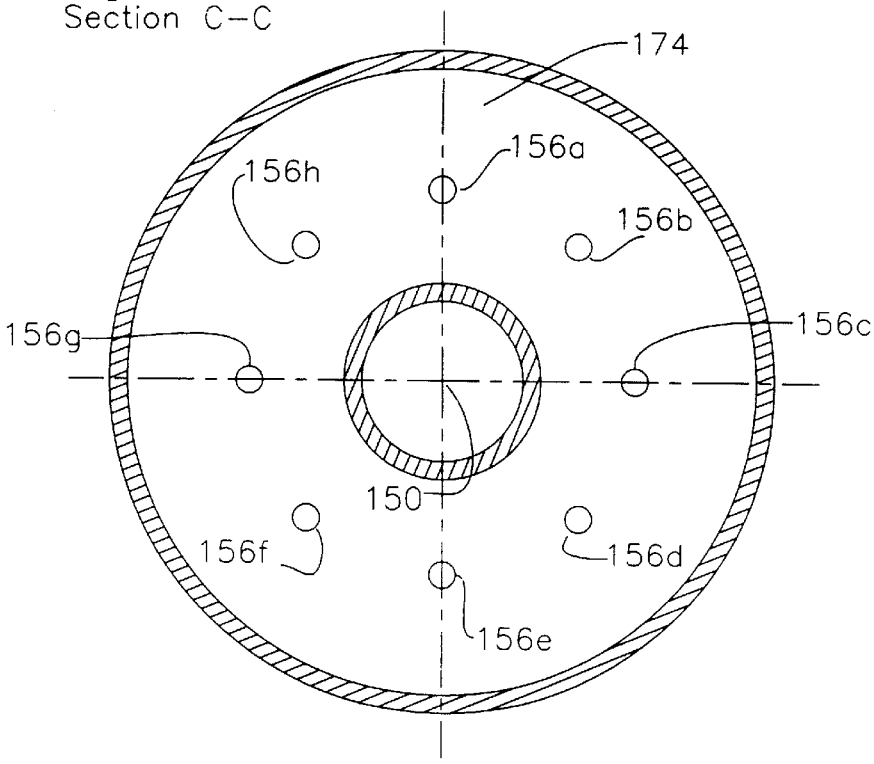

FIGS. 4*a*, 4*b*, and 4*c* show cross section views of the present invention, and may be examined in conjunction with corresponding sections a—a, b—b, and c—c of FIG. 4. A plurality n of electron guns 230*a*, 230*b*, . . . 230*n* is arranged circularly around a central axis z 150. A reference plane R is perpendicular to the axis Z 150, and is used in the illustrations for section a—a, b—b, and c—c. FIGS. 4*a–c* show a cross section view of a device where n=8. Each electron gun 230*a* . . . *n* is arranged circularly around the central axis Z and produces a beamlet which initially focuses to a minimum diameter 106*a* . . . *n*, as described earlier in FIG. 2. As is clear to one skilled in the art, other non-circular and irregular inter-gun spacings can be used, but the regular spacings and circular arrangement is shown for clarity in the drawings. Each beamlet from each electron gun 230*a* . . . *n* travels through its own beam tunnel 156*a* . . . *n* along a beam tunnel axis 152*a* . . . *n* to a collector 112*a* . . . *n*. Each beamlet travels in its respective beam tunnel 152*a* . . . *g* which has a conductive inner surface 173, and the beam tunnel comprises drift tubes 133, 135, 137, and 139, and a series of resonant cavities 172, 174, 176 formed by drift tube gaps, and shown in FIG. 4-1 detail. These cavities are for the introduction of RF power, additional modulation of the electron beamlets, and the extraction of RF power, as before. The coaxial magnetic flux field generator 131 comprises a coil wound around the axis 150, which produces a generally uniform flux field aligned with the central axis 150, as before. The resonators are shown as 172, 174, 176 comprise the annular ring resonators described, for example, in U.S. Pat. No. 4,508,992 by Bohlen et al (items 1 and 2), incorporated herein by reference. A key feature of the embodiment shown in FIG. 4 is the presence of an iron structure 170 and electromagnetic coil or permanent magnet 180, located along the centerline of the device and positioned at the approximate location of the individual cathodes 102. The iron structure 170 and magnet 180 provide compensation for the radial asymmetry of the magnetic field at the location of the individual cathodes 102, as will be described later.

FIGS. 4*a–c* shows the sections a—a, b—b, and c—c, which include beam tunnels 156*a* . . . *n*, and the inner surface 173 and outer surface 171 of resonators 174.

Figure 5:
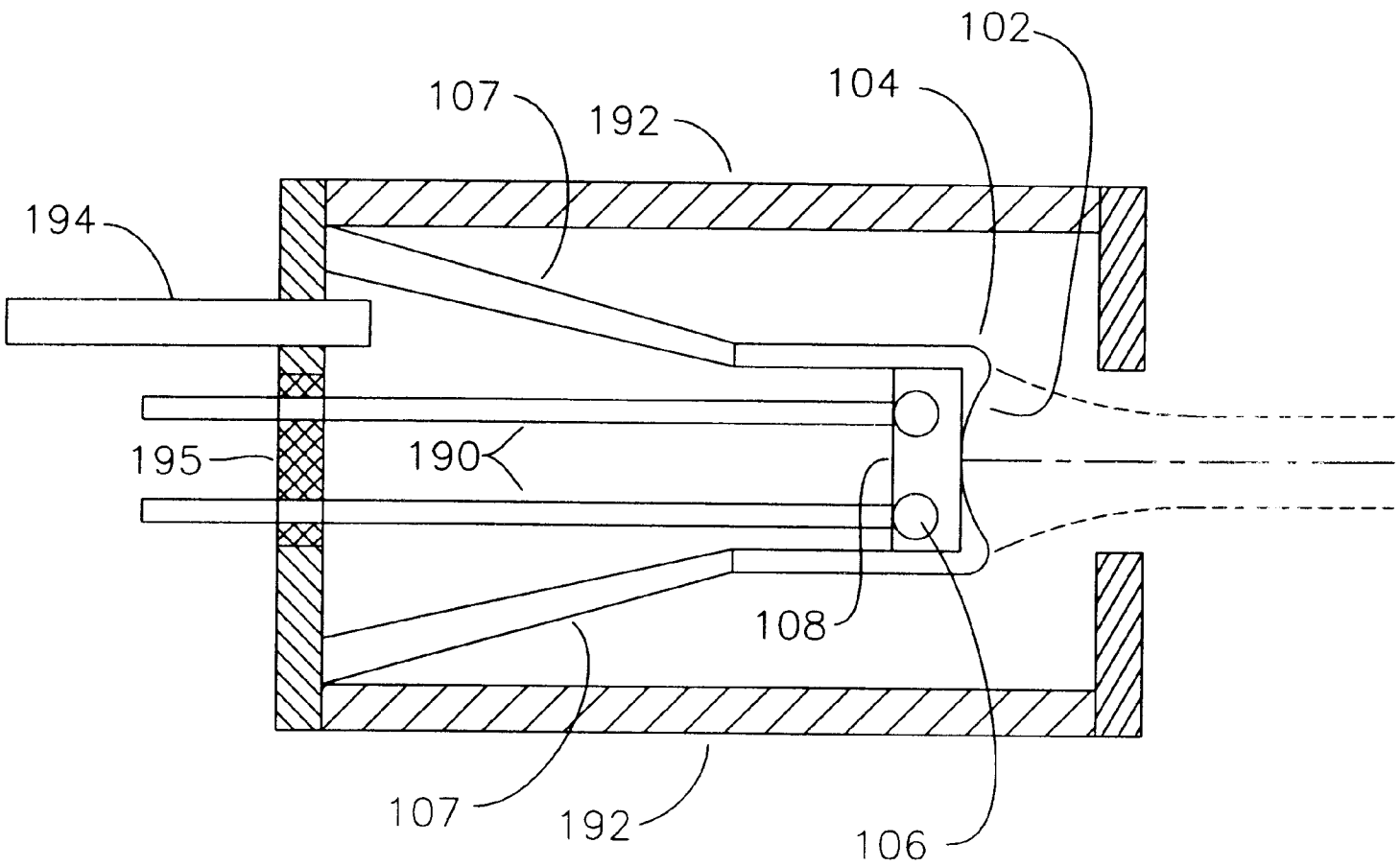
Figure 5 Prior Art
FIG. 5 is a section view of the electron gun shown in FIG. 4.

FIG. 5 shows the key elements of the individual electron guns which include a thermionic emitting surface 102, focus electrode 104, cathode heater 106, heat shields 108, insulating ceramic 192, vacuum pumpout 194, and insulating ceramic 195 for the heater wire feedthrough 190.

In the present invention as described in FIGS. 6 through 10, magnetic circuits are disclosed which provide for individual focusing of each beamlet to insure optimum beam transport through the RF device. The magnetic circuits include a series of electromagnet coils or permanent magnets that provide the magnetic field and appropriately placed magnetic iron structures to shape the field as required by each beamlet. In particular, magnetic iron is incorporated near each individual cathode to bend the magnetic field lines so that they are everywhere perpendicular to the emitting surface as required for laminar electron flow. Magnetic iron is incorporated around the main magnet coils or permanent magnets to provide for proper flux leakage into the cathode-anode region and to guide the electron beamlets through the circuit of the RF device.

For some high frequency and high power applications it may be convenient to employ a klystron using ring resonator cavities. Ring resonator cavities allow for location of the electron beamlets at a larger radius from the device axis than is possible with simple fundamental mode cavities.

Figure 6A:
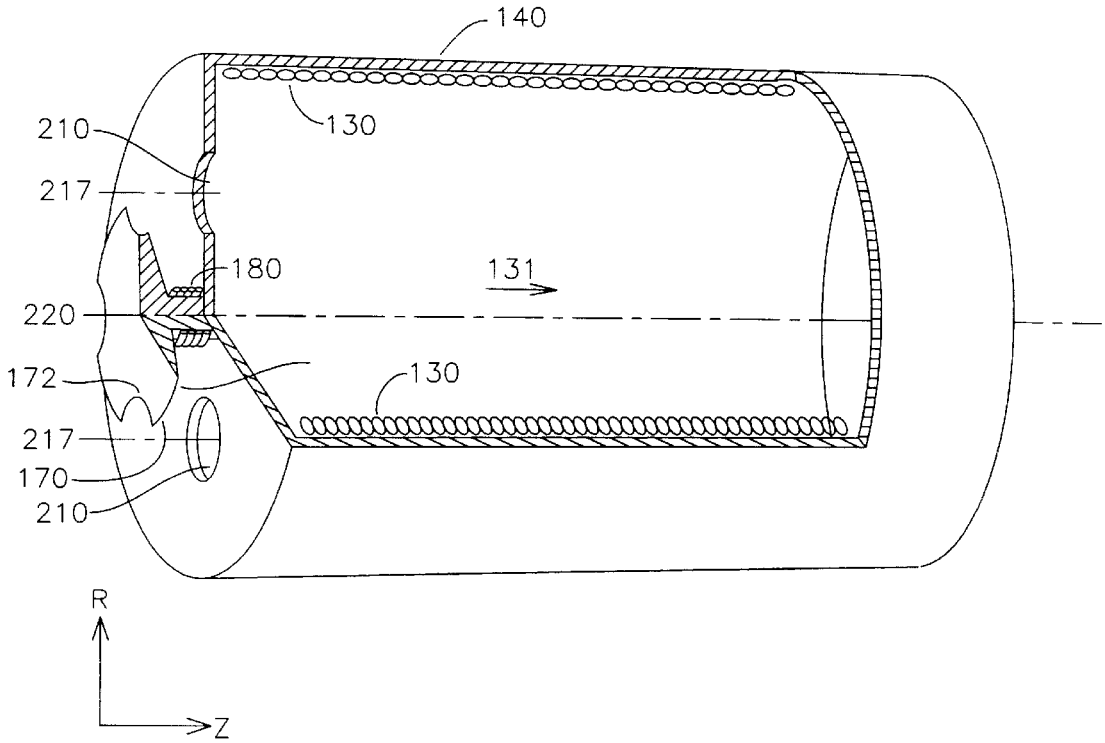
FIG. 6*a* is a three dimensional view of the magnetic circuit of FIG. 4 showing an electromagnetic coil and shaped iron structure in the gun region for reducing radial and azimuthal asymmetries at the cathode locations.

An embodiment of the magnetic circuit for the device of FIG. 4 is shown in FIG. 6*a*. A shell of magnetic iron 140 encloses magnetic coils 130 that generate the main magnetic field for the RF device. As is clear to one skilled in the art, it would be possible to substitute a self-magnetic structure such as a permanent magnet for the coil 130 with appropriate modifications to iron structure 140. Apertures 210 are placed in the end walls of the shell 140 to allow passage of the electron beamlets and to allow magnetic flux to extend into the cathode-anode regions 106 of the electron guns to aid in beam focusing. An auxiliary electromagnet coil or permanent magnet 180 is located along the device centerline 220 and between the centerline and the individual electron guns 230. In addition magnetic material 170 is located along the device centerline 220 and between the electron guns 230 and the centerline 220. The magnetic iron 170 may include semicircular extensions 172 extending partially around the centerline of each individual beamlet 217 to reduce azimuthal asymmetries in the magnetic field at the location of the individual cathodes 102.

Figure 6B:
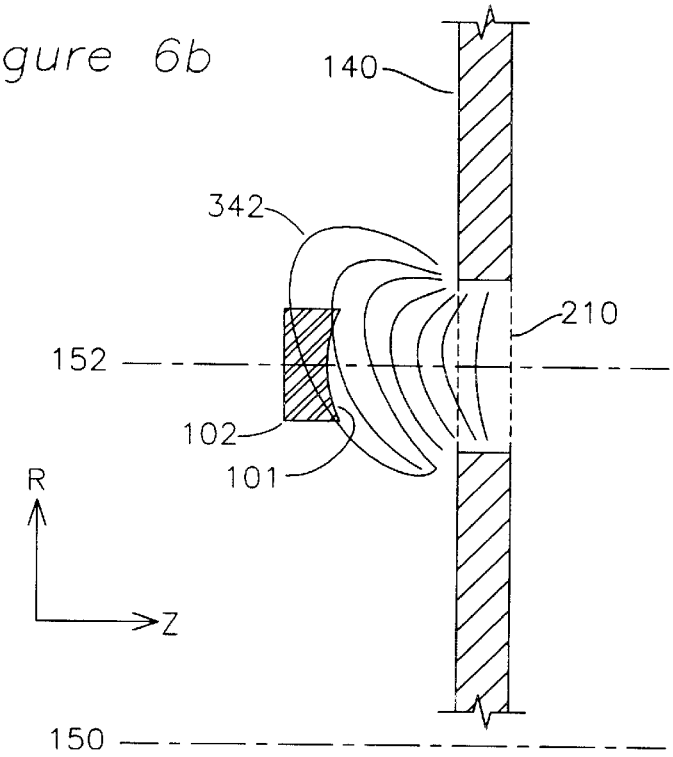
FIG. 6*b* is the cross section of the uncorrected magnetic field and the envelope of the electron beam produced by an uncorrected off-axis electron beam of FIG. 6*a*.

FIG. 6*b* shows a section in the RZ coordinate system in the region between the magnetic polepiece end plate 140 and the electron gun emitter 102 where no correction is made to the magnetic field using coil 180 or magnetic structure 170. The figure plots contours of constant magnetic field 342 emanating through aperture 210 and extending to cathode 102. Note the asymmetry about the cathode centerline 152 and the variation of magnetic field across the emitting surface 101 of the cathode 102. Electrons emitted perpendicular to surface 101 will experience a magnetic field in which the direction of the magnetic field vector is different from the direction of electron motion, thereby imparting a transverse force on the electron that will prevent proper transmission through the RF device.

Figure 6C:
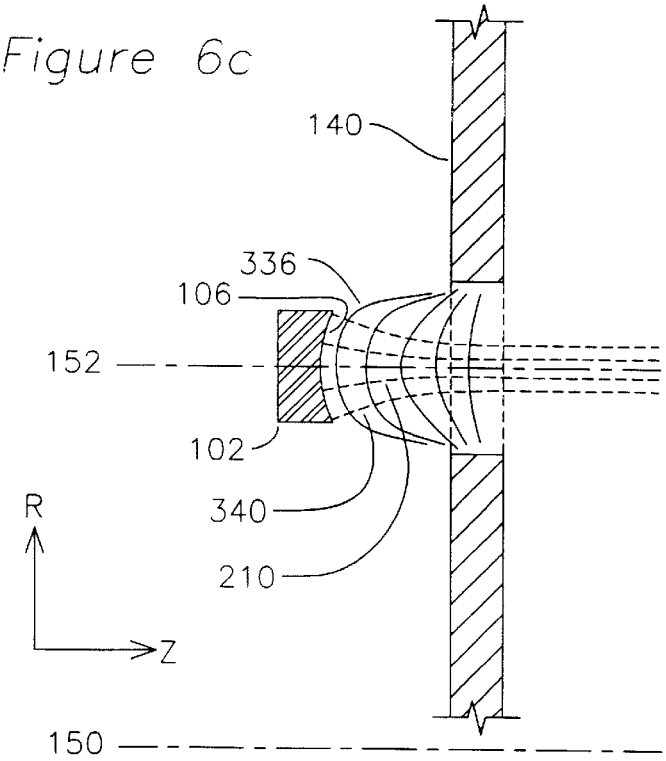
FIG. 6*c* is the cross section of the corrected magnetic field and the envelope of the electron beam produced by the configuration of FIG. 6*a*.

FIG. 6*c* shows equipotential magnetic flux lines in the vicinity of the electron beam aperture 210 with auxiliary coil 180 and magnetic material 170. It can be seen that the equipotential magnetic flux lines 336 and the electron beam paths 340 are perpendicular. Thus the direction of electron motion is parallel to the magnetic force direction, eliminating magnetically induced forces perpendicular to the direction of electron motion, which causes the electron beam to experience confined flow with no trajectory divergence or beam spreading.

Figure 7:
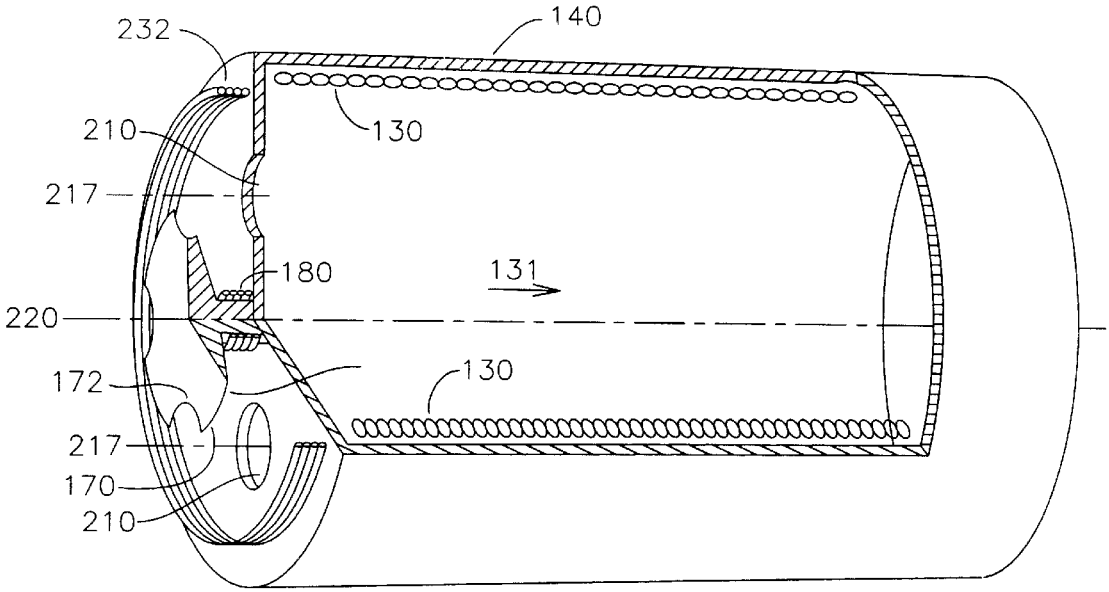
FIG. 7 is an alternate embodiment of the configuration of FIG. 6*a* with an auxiliary electromagnet or permanent magnet surrounding the plurality of cathodes.
Figure 8:
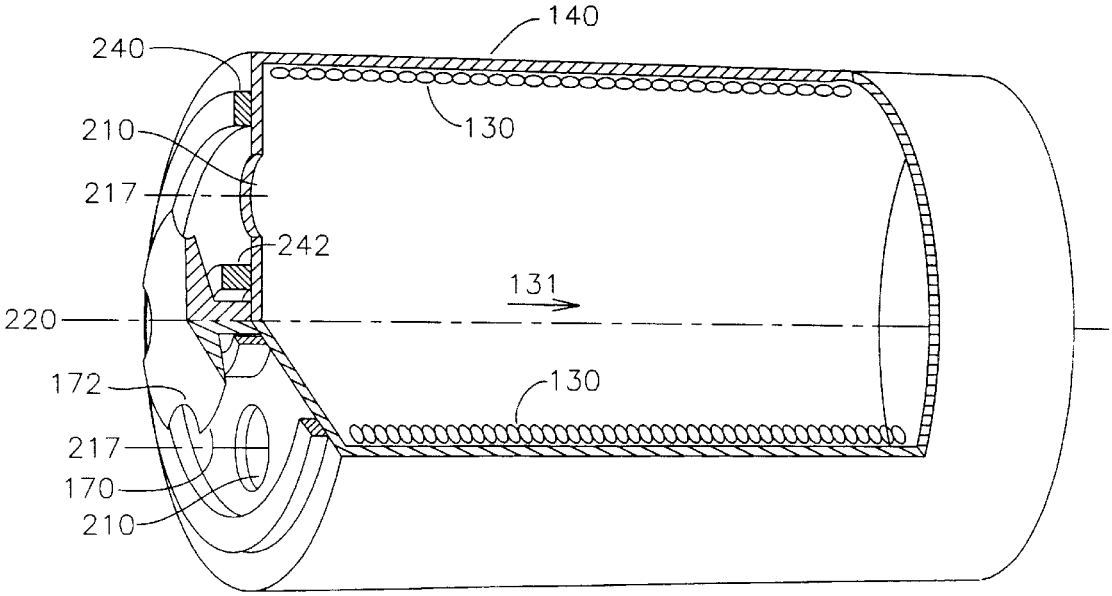
FIG. 8 is an alternate embodiment of the configuration of FIG. 6*a* with an auxiliary permanent magnets surrounding the plurality of cathodes and a permanent magnet interior to the plurality of cathodes.

An alternate embodiment is shown in FIG. 7, where an additional field shaping electromagnet coil 232 is located about the centerline of the device 220 but at a distance from the centerline so as to surround the cathodes for the individual beamlets. As is clear to one skilled in the art, and shown in FIG. 8, permanent magnets 240 and 242 could be substituted for coils 232 and 180 of FIG. 7 with no change in function. Field shaping electromagnet 232, or 180 or shaping magnet 240 or 242 would equivalently allow additional control of the magnetic field in the region of the electron beamlets. An alternate embodiment would include an iron shield partially enclosing coil 232 on the outer circumference and end to limit flux leakage into the environment and reduce the power required for electromagnetic coils or the field strength for permanent magnets. As is clear to one skilled in the art, there are many combinations of electromagnets or permanent magnets which could be used to satisfy the condition of creating a magnetic field which is perpendicular in gradient to the electron beam trajectory over all operating regions of the device.

Figure 9:
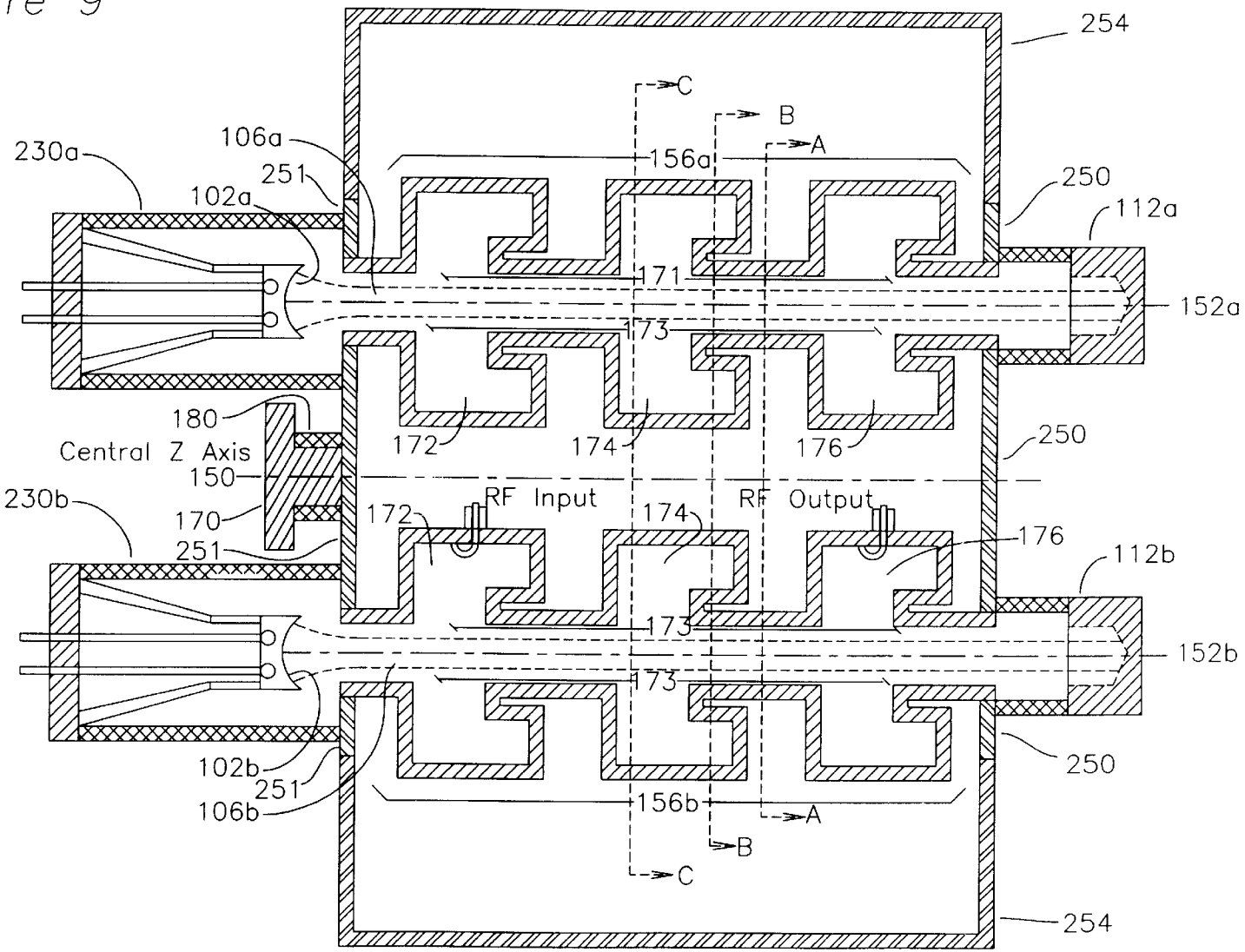
FIG. 9 is the device of FIG. 4 where permanent magnets are used in place of electromagnets.

FIG. 9 shows the device of FIG. 4 wherein the iron 140 and magnetic coils 131 are replaced by iron 250, 251, and permanent magnet 254 respectively.

Figure 10:
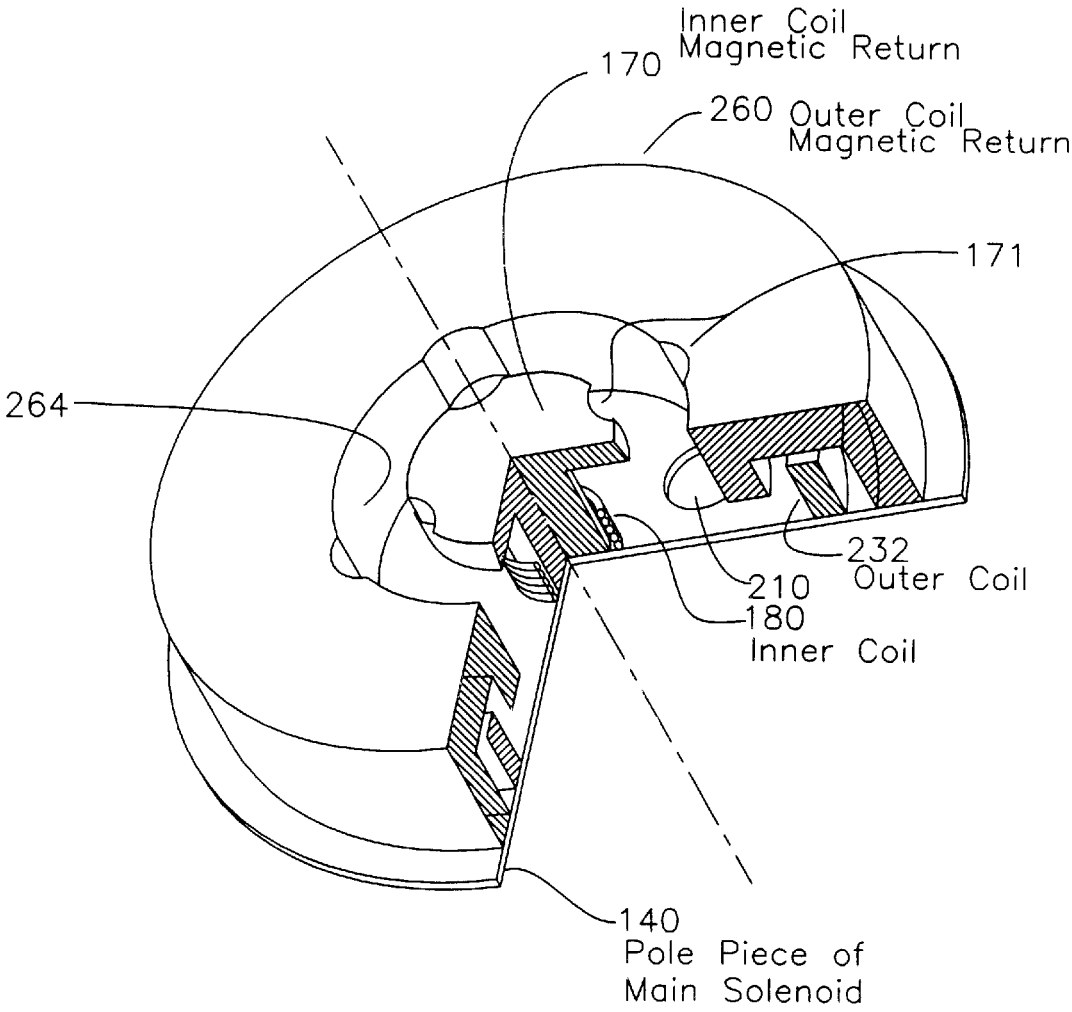
FIG. 10 is the device of FIG. 4 including additional magnetic material surrounding the plurality of cathodes to provide additional field correction.

FIG. 10 shows an alternate embodiment of the multiple beam device where additional magnetic material 260 is incorporated at a larger radius than the electron guns 230 and interior to outer magnetic coil or permanent magnet 232. The magnetic material may contain specially shaped surfaces 264 to further correct the magnetic field for radial or azimuthal asymmetries in cooperation with coils 232 and 180 and interior magnetic structure 170.

Figure 11:
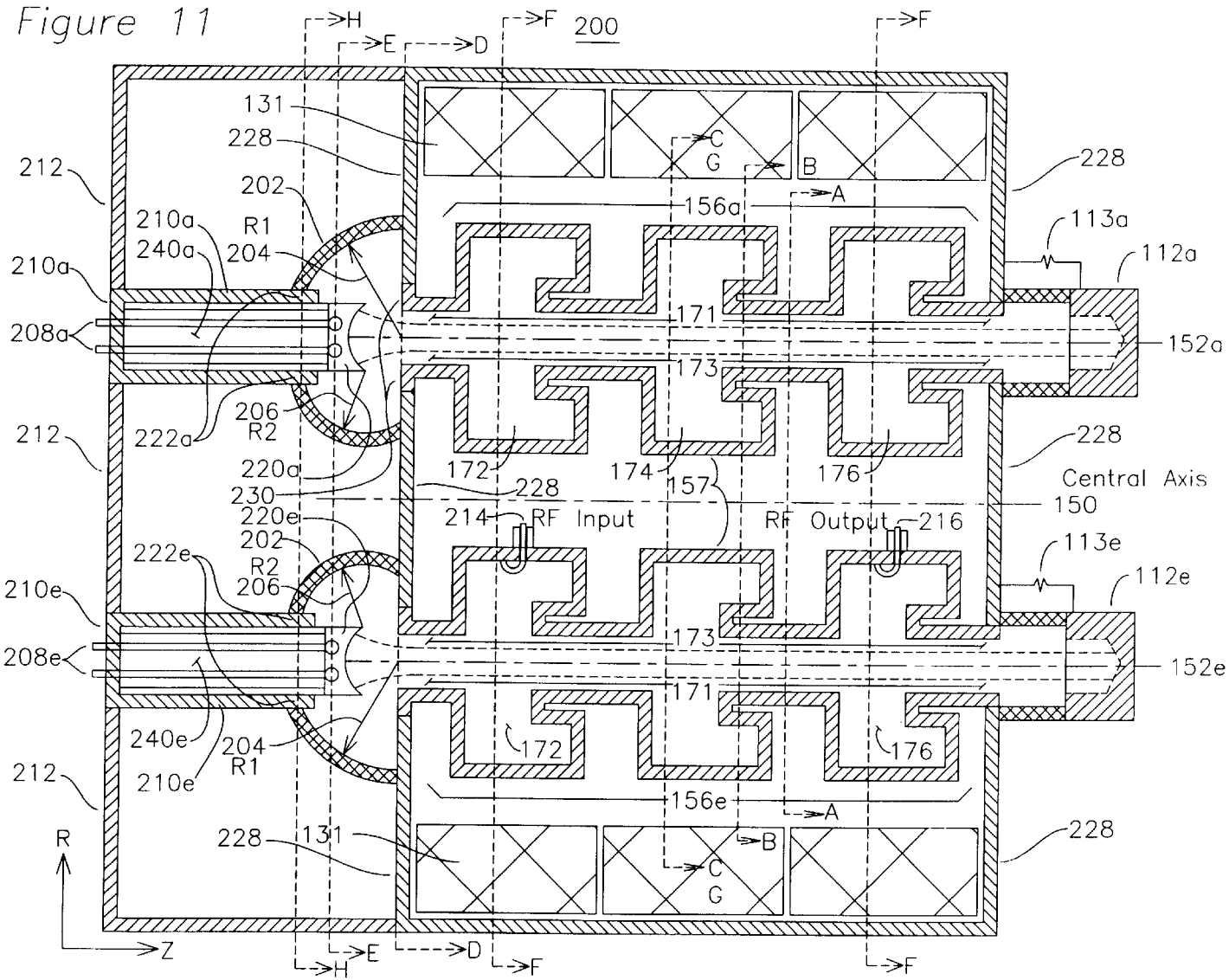
"FIG. 11 is a multi-beam electron gun klystron with passive magnetic field compensation.

FIG. 11 shows a cross sectional view of a convergent multiple beam klystron 200 with a plurality of electron beams. The section of FIG. 11 is taken in the R-Z plane, which includes the central axis 150, and the centerline of two of the electron guns 152*a* and 152*e* for clarity. While an even number of electron guns is shown, any number of electron beams disposed about the central axis could be implemented. As was shown earlier in FIG. 4, the convergent multiple beam klystron includes a solenoidal field generating coil 131, and the aperture formed by the anodes 230*a–h* in the magnetic field enclosure 228 allows flux leakage into the cathode area 220*a–h*, as was described for convergent flow systems. The electron beam from each electron gun 240*a . . . n* is reduced in diameter and enters the RF circuit 157 via an anode end 230*a* proximal to the cathode 220*a*. The RF circuit 157 can take many different forms, but may comprise an RF input gap 172 for the introduction of RF into the electron beams, thereby modifying their axial velocity in a time varying manner, one or more bunching chambers 174 which act as a resonator, and an output chamber 176 for the removal of RF energy. While the input cavity 172 and output cavity 176 are common to all beam tunnels 156*a . . . n*, the bunching cavities 174 may be individually formed around each beam, or they may be shared as a common cavity. In this manner, the individual electron beams leaving cathodes 220*a . . .* 220*n* travel past the anode ends 230*a . . . n*, through their respective beam tunnel axis 152*a . . . n*, of the RF circuit 157, and terminate in individual collectors 112*a . . . n*. Resistors 113*a . . . n* are placed electrically between the insulated collector 112*a . . . n* and anode potential shield 228, and may be used to measure the beam current in each beam tunnel to determine beam losses related to the beam impinging on the RF circuit 157 for each beam tunnel. RF circuit 157 is formed from a non-ferrous conductor such as copper, which preserves uniformity of the magnetic field inside the magnetic enclosure 228, and allows the field to escape the beam tunnels to the cathodes 220*a–n*, as required by confined flow devices.

The cathode facing end of the RF circuit 157 includes an area formed to act as a circularly symmetric anode, shown as 230, and is connected to a positive voltage with respect to the cathodes 220*a* . . . *n*. Each cathode 220*a* . . . *n* is heated to thermionic temperatures by heaters fed from heater leads 208*a* . . . *n*, which are fed through an insulating material 210*a* . . . *n*. The heater leads 208*a* . . . *n* may also carry the negative potential of the electron gun, while the RF circuit 157 anode end 230 carries a positive potential. Insulator 210*a* is of sufficient thickness and geometry to ensure that the high potential differences between the cathodes 220*a* . . . *n* are isolated from the magnetic field correctors 202*a* . . . *n*, which is at the same potential as the magnetic field enclosure 228 and anodes 230*a* . . . *n*, and to form a vacuum seal to ensure that the cathodes 220*a* . . . *n* and beam tunnels 156*a* . . . *n*, are maintained in a vacuum. The shared RF circuit 157 includes gaps 172, 174, 176 which form resonant cavities, and include an RF input port 214 and RF output port 216. Inner drift tube surface 173, and outer drift tube surface 171 are shown, and were described in the sections A—A and B—B of FIGS. 4*a* and 4*b*. The case of a shared bunching cavity 174 is the section C—C and was shown in FIG. 4*c*. The case of separate buncher cavities is shown in the section G—G, and appears as FIG. 12*e*. The magnetic field which. confines the elecron beam is generated by a solenoidal magnetic coil 131, although any such field generator could be used, including a permanent magnetic material, as was shown in FIG. 9. The shaping of the magnetic field about the cathodes 220*a* . . . *n* to guide the beam down the central axis of the beam tunnels 156*a* . . . *n* is done by field corrector 202, which, in its simplest form, is a solid of rotation formed by rotating a shape about the central axis 150, and has individual cathode-holes 222*a* . . . 222*n* for the insertion of each electron gun 240*a* . . . *n* and insulator 210*a* . . . *n*. The function of the field corrector 202 is to alter the magnetic field which escapes through the apertures in the field container 228 so as to be optimally perpendicular to the surface of each cathode 220*a* . . . *n*. The shape of the magnetic field corrector is roughly described by an upper arc of radius R1 204, and a lower arc of radius R2 206. The magnetic field corrector is made from a magnetic material such as iron, and includes a non-electrically conductive gap 222*a* . . . *n* enclosing an insulator and vacuum seal 210*a* . . . *n* to electrically and thermally isolate each cathode 220*a* . . . *n* from the field corrector 202 and magnetic enclosure 228. An end cap 212 is used to support the electron guns, provide electrically isolated and thermally isolated heater connections, and maintain the vacuum of the klystron or RF device 200. optionally, end cap 212 may also enclosure a cooling fluid such as oil, which is separated by the vacuum on the cathode side of corrector 202 by insulators 210*a* . . . *n*. Section D—D showing the axial relationships of the end cap 212, magnetic field enclosure 228, beam tunnels 156, and RF circuit 157 in FIG. 12*a*, and section E—E is shown in FIG. 12*b*. A section view of the magnetic field corrector in the vicinity of the electron guns is shown in section E—E, and the input and output cavities are shown in section F—F. Section G—G shows the bunching cavities for the individual cavity alternate construction, and section H—H shows the relationship between the electron guns 240 and magnetic field corrector 202.

Figure 12A:
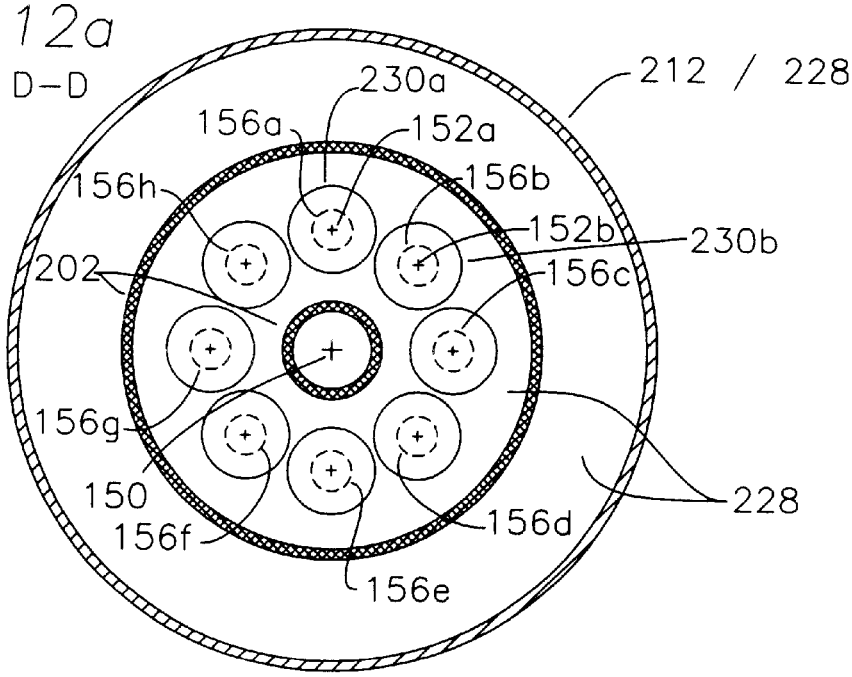
FIG. 12*a* is the section D—D of FIG. 11.
Figure 12B:
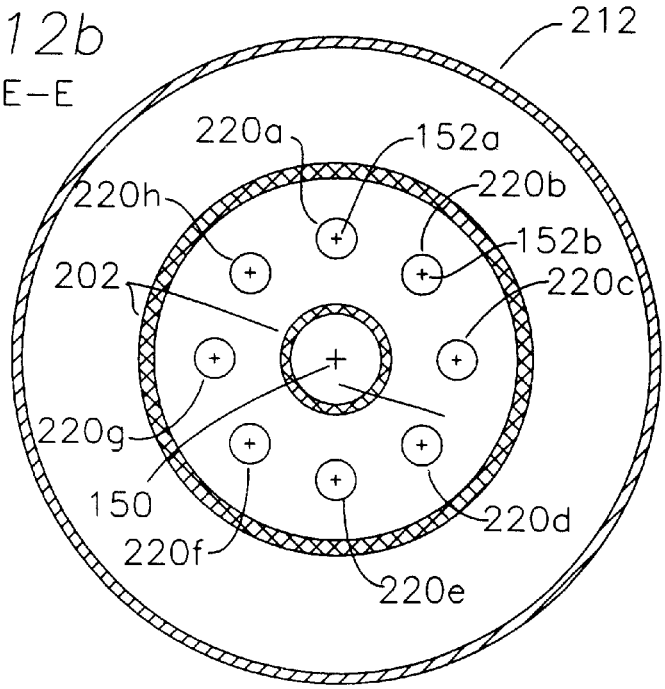
FIG. 12*b* is the section E—E of FIG. 11.

FIG. 12*a* shows the section D—D of FIG. 11 at the joint between the end cap 212 and magnetic field enclosure 228 for the case where the number of guns is 8, and the spacing is uniform. Beam tunnel centers 152*a* . . . *n*, beam tunnels 156*a* . . . *n*, anodes 230*a* . . . *n*, and magnetic enclosure 228 and end cap 212 which appear in section D—D are shown, as well as the section of magnetic field corrector 202.

FIG. 12*b* shows the section E—E of FIG. 11, and includes the end cap 212, beam centers 152*a* . . . *n*, cathodes 220*a* . . . *n*, and magnetic field corrector section 202.

Figure 12C:
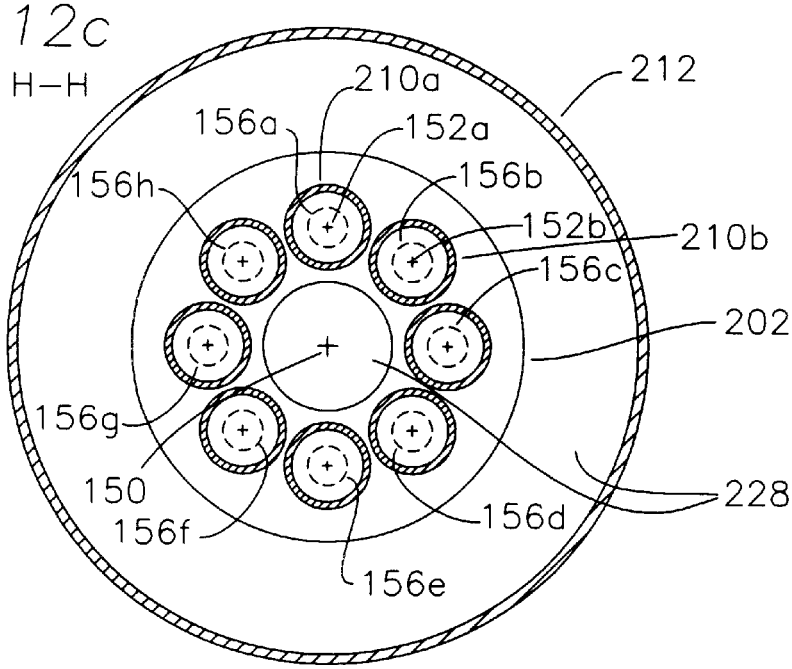
FIG. 12*c* is the section H—H of FIG. 11.

FIG. 12*c* shows the section H—H at the opening of the magnetic field corrector. End cap 212, and the magnetic field corrector 202 including the individual apertures 222*a* . . . *n* which allow for the insertion of the electron guns and insulators 210*a* . . . *n* about beam tunnel centers 152*a* . . . *n*. Beam tunnels 156*a* . . . *n* are included for clarity, although are not formally a part of the section H—H.

Figure 12D:
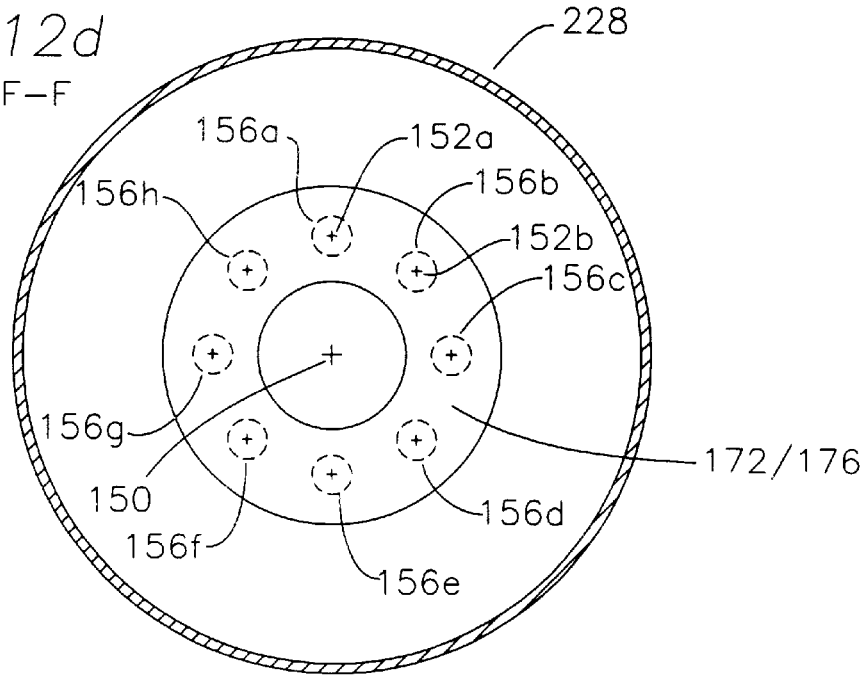
FIG. 12*d* is the section F—F of FIG. 11.

FIG. 12*d* shows the structure of the RF circuit 157 input RF circuit 172 or output RF circuit 176 detail. This includes the beam tunnel centers 152*a* . . . *n*, beam tunnels 156*a* . . . *n*, and magnetic field enclosure 228.

Figure 12E:
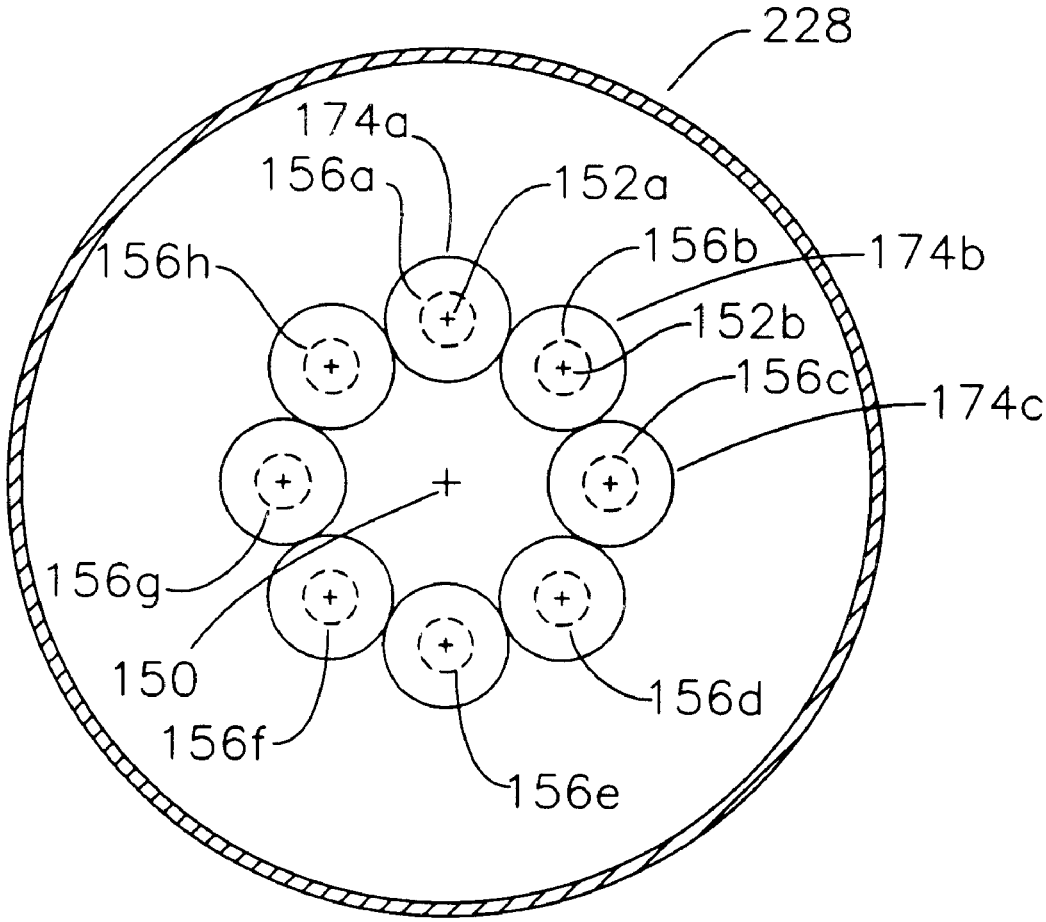
FIG. 12*e* is the section G—G of FIG. 11.

The earlier FIG. 4*c* showed the center bunching RF circuit 174 as a common structure shared by all electron beams. In FIG. 12*e*, the bunching RF circuits are shown as separate chambers 174*a* . . . *n*, and the other structures remain as earlier described.

Figure 13:
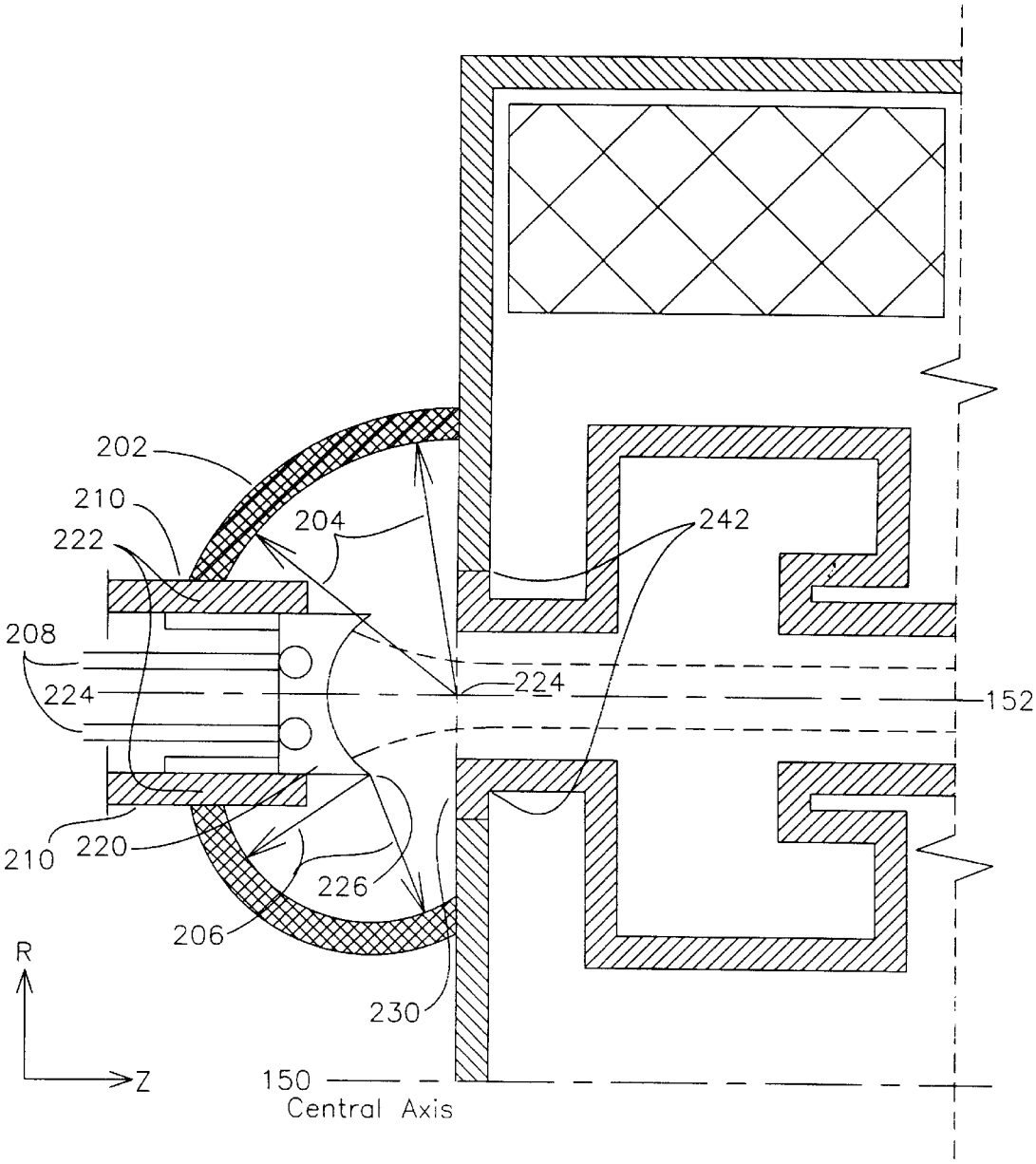
FIG. 13 is a detail view of the construction of the magnetic field-compensator and electron gun.

FIG. 13 shows the details of construction for the magnetic field corrector 202 with a magnified view of the a part of the corrector as appears in FIG. 11. Central axis 150, and beam tunnel axis 152 are used in conjunction with the front planar surface of the anode 230 to determine a first radius point 224. The first radius point 224 is used to sweep a first radius R1 204 in the R–Z plane which includes the central axis 150 and a beam tunnel axis 152. This radius point may be located within half a diameter distance of cathode 220, but may be also located on the central axis and planar to the end cap as shown. A second radius point 226 which is also in the same R–Z plane, is located a first distance from the edge surface of the cathode closest to the central axis 150, where this first distance is less than half the diameter of the cathode. It is understood that the exact locations of first radius point 224 and second radius point 226 are determined by numerical optimization of the magnetic field for perpendicularity to the electron emitting surface of cathode 220. Sweeping the second radius in the R–Z plane about the second radius point 226 generates the curve shown having radius 206. Sufficient thickness of magnetic field corrector 202 is added to enclose the flux leaving said enclosure 202. As the objective of the design of magnetic field corrector 202 is the perpedicularity of magnetic field to the surface of the cathode, it may be possible to further improve the design using numerical magnetic field estimators, thereby achieving improved magnetic field orthogonality over the first order correction shown.

An important and limiting result that has been shown theoretically and has been measured in multi-beam klystrons is the tendancy of the electron beam to travel in a helical path, rotating about the central axis 150 as it travels down the z axis of the beam tunnel axis 152. The helical travel causes an increasing deviation from the center of the beam tunnel 152 until the beam impinges on the drift tube wall of the beam tunnel. This impingement causes degredation of the performance of the tube, as well as sufficient local heating to consume the drift tube wall. An important geometrical modification which has the effect of canceling this helical path is an azimuthal offset of the magnetic field corrector about the central axis 150, as shown in FIG. 14.

Figure 14:
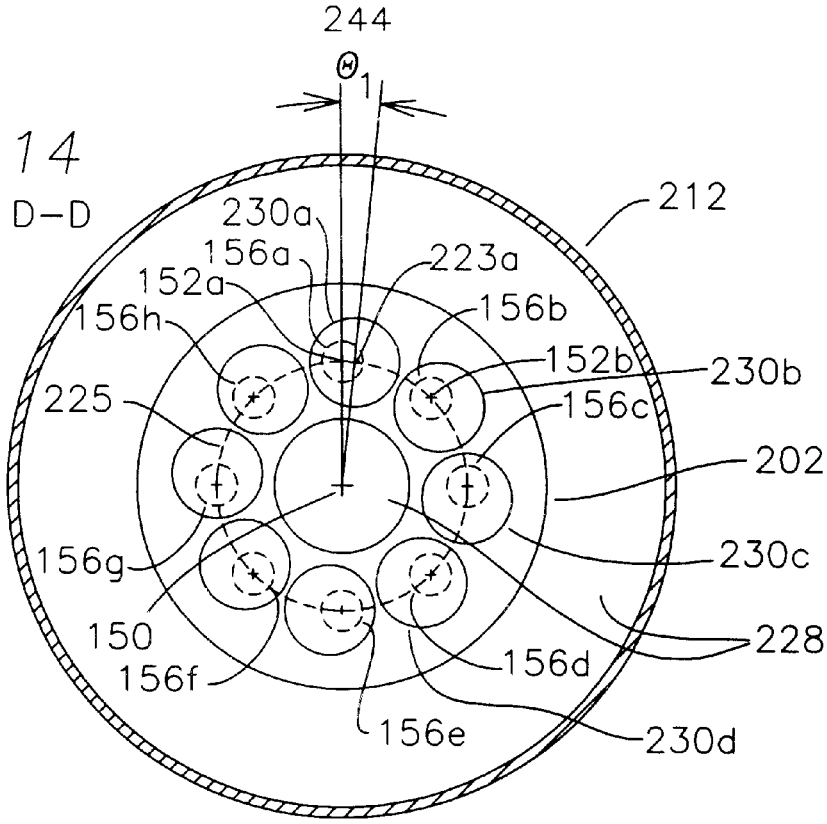
FIG. 14 is the section H—H of FIG. 11 including helical trajectory compensation.

FIG. 14 shows the section D—D as was shown in FIG. 12*a*, however the magnetic field corrector aperture has been rotated azimuthally by an angle θ1 244. For reference, the centers of the cathodes 220*a* . . . *n* are described by reference circle 225, and the center of one such cathode is at point 152*a*, while the corresponding center of one of the anodes

230*a* is shown as 223*a*. When the cathodes 220*a* . . . *n* and magnetic field corrector 202 are rotated together by θ1 244 to generate this azimuthal offset between the centers of the cathodes 220*a* . . . *n* and the centers of the anodes 230*a* . . . *n*, a small but canceling helical force is presented to the electron beam, and the beams traverse down the centers of the beam tunnels 152*a* . . . *n* without helical displacement as they travel in the z axis. The exact value for θ1 244 may be computed numerically using a field analyzer, or it may be determined experimentally. Beam losses related to the beam impinging on the walls of the beam tunnel may be measured by the voltages developed across resistors 113*a* . . . *e* of FIG. 11, as was described earlier.

Figure 15:
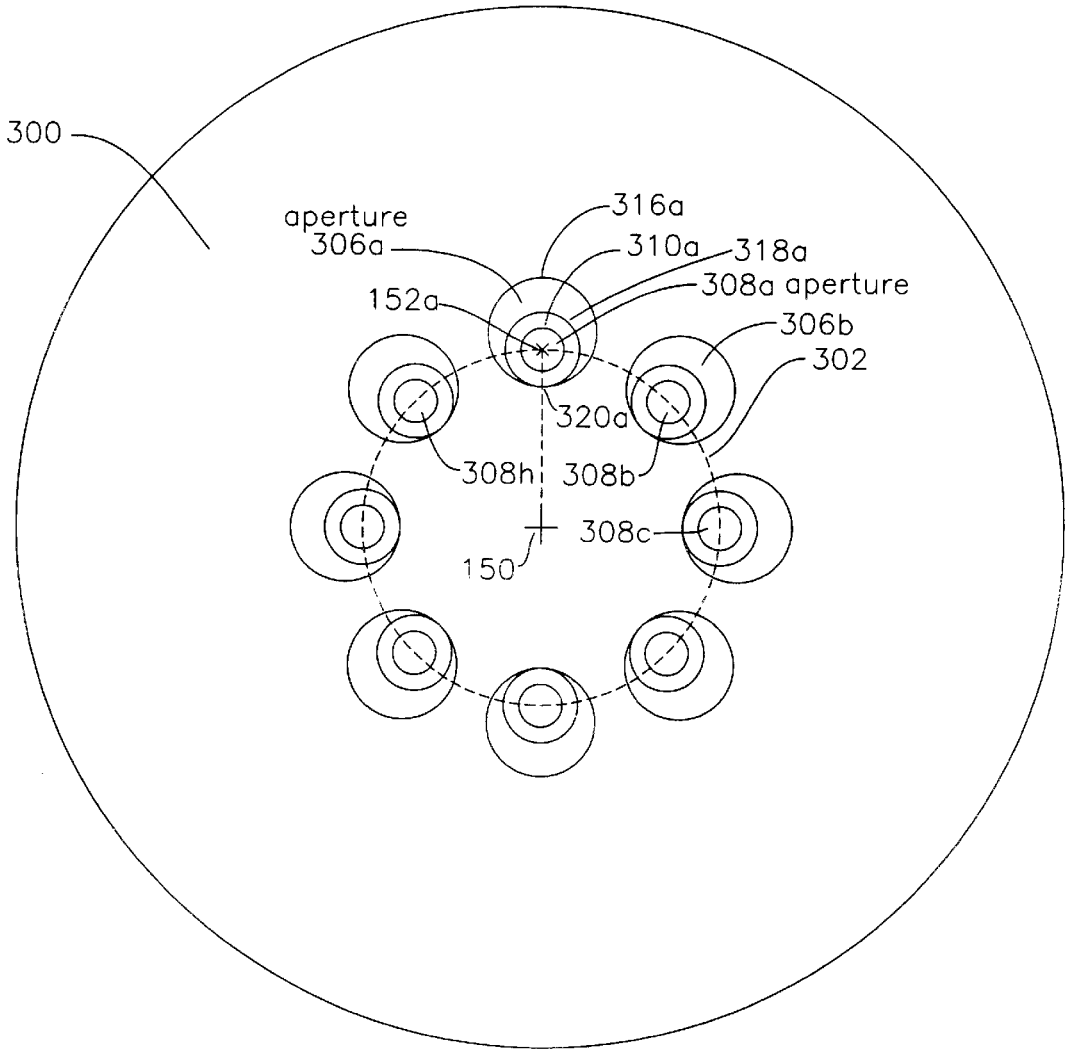
FIG. 15 is the front view of a magnetic field compensating end cap.

FIG. 15 shows a magnetic field correcting end cap for use with a multibeam magnetic circuit. The end cap 300, like the rest of the magnetic field enclosure, is fabricated from a material with high magnetic permeability such as iron and has a central axis 150 corresponding to the central axis of the previous figures. A series of crescent shaped magnetic field correcting apertures 306*a* . . . *n* are added to the regular beam tunnel apertures 308*a* . . . *n*. Each of the crescent shaped magnetic field correction apertures 306*a* . . . *n* are defined by a first circle 318a and second circle 316*a* sharing a tangent point 320*a* which is located on a line from the center of the beam tunnel 152*a* to the central axis 150. The first circle 318*a* has a center at the beam tunnel center 152*a*, and the second circle 316*a* has a diameter larger than the diameter of the first circle 318*a*, and shares tangent point 320*a*. The actual diameters of the first circle and second circle are chosen to produce a magnetic field which is maximally perpendicular to the surface of the cathode. The design of the crescent magnetic field corrector for optimization of perpendicularity of flux lines to electron emitting cathode surface may be done using any of the numerical field solvers commonly available and known to one skilled in the art of magnetic circuit design. Since each beam tunnel is generally uniformly spaced around the central axis 150, the beam tunnel apertures 152*a* . . . *n* and crescent magnetic field correcting apertures 306*a* . . . *n* are uniformly spaced around the circle 302 and separated by an angle 360/n degrees. For clarity, only the details of construction for the first beam tunnel and magnetic field aperture corrector are shown, and the others are understood to be identical to the first beam tunnel and magnetic field aperture rotated about the central axis by the angle 360/n degrees, where n is the number of such beam tunnels and electron guns.

Figure 16A:
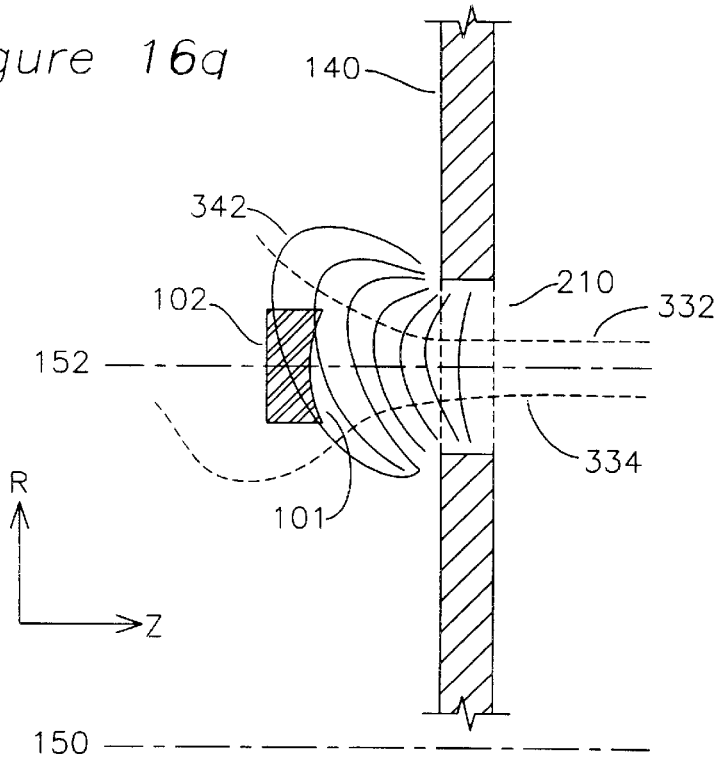
FIG. 16*a* and 16*b* show the side view of the interaction of a magnetic field and a field compensating end cap"

FIG. 16*a* shows a section view through the end cap and beam tunnel axis 152*a* showing the uncompensated field contour 342 and the flux deviation from the ideal perpendicular to the cathode 102. It can be seen that the flux lines 334 near the central axis 150 are close to perpendicular to the cathode, while flux lines 332 on the opposite side of the beam tunnel from the central axis 150 deviate from perpendicular. The effect of the crescent field corrector can be seen in FIG. 16*b*.

Figure 16B:
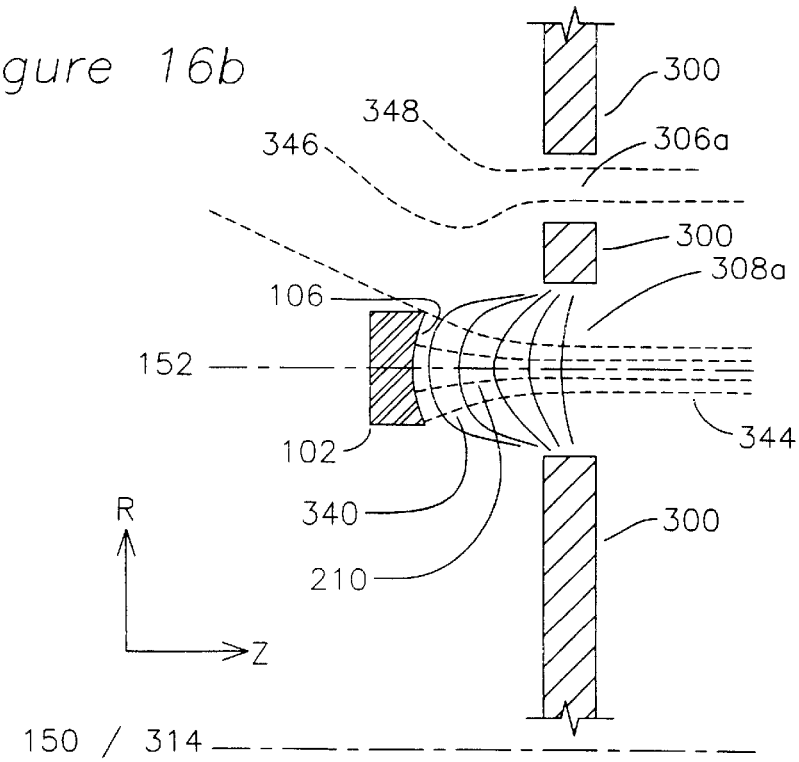

FIG. 16*b* shows a section view as FIG. 16*a* using the magnetic field correcting end cap 300 of FIG. 15. Field correcting end cap 300 includes the beam tunnel aperture 308*a* and crescent aperture 306*a*. Beam tunnel axis 152 cathode 102 now has magnetic flux lines 210, 340, and 344 which are perpendicular to the cathode surface 106. This correction is performed by crescent aperture 306*a* which allows flux lines 346 and 348 to modify the flux in the viscinity of the cathode surface 106 to allow perpendicularity.

In the preceding descriptions and illustrations, and as stated in the objects of the invention, many different structures may be used which separately or in combination to enable a multiple electron gun magnetic circuit, such magnetic circuit which shares the following common elements:

1) a magnetic field enclosure which may be cylindrical and having a central axis and end caps. This magnetic field enclosure may be made of any high permeability material such as iron, and is preferably of sufficient thickness to contain the magnetic field without magnetic field saturation within the field enclosure.

2) a magnetic field generator for the creation of a magnetic field within he magnetic field enclosure. This magnetic field generator may be an electromagnetic or a permanent magnet, and the magnetic field is typically oriented along the central axis of the magnetic field enclosure.

3) a plurality of beam tunnels coupled to a plurality of electron guns, the electron guns having a thermionic cathode external to the magnetic field enclosure, typically located near an end cap, and the end cap having a corresponding aperture for electrons to pass from the cathode, through the end cap, and through the beam tunnel.

4) a magnetic field correction surrounding or adjacent to the cathodes to ensure the magnetic field experienced by the cathodes is perpendicular to the thermionic emitting surface of the cathode. This magnetic field correction can take many different forms, as shown in the previous illustrations. In addition, since the structures are generally not mutually exclusive, they may be used in any combination. The specific structures described herein include the electromagnetic coil 180 of FIG. 7, the permanent magnet 242 of FIG. 8, both located on a circle with a center on the central axis and located inside the extents of the beam tunnels, the rod and disk structure 170 with aperture cutouts 172 located on the central axis 220 of FIG. 7 or 8, the electromagnet 232 of FIG. 7, the permanent magnet 240 of FIG. 8, both located on a circle beyond the extents of the beam tunnels, the inner coil magnetic return 170 and the outer coil magnetic return 260 of FIG. 10, the solid of rotation 202 of FIG. 13, with or without the axial rotation shown in FIG. 14, and the crescent apertures shown in FIG. 15. These structures may be used individually or in combination to produce the perpendicular flux lines required at each thermionic emitting surface 102 of the electron gun of FIG. 5.

5) An RF circuit having one or more input ports, one or more output ports, and optionally some gain structures which utilizes the plurality of beam tunnels either individually, or in common. There are many different types of RF circuits which are suitable for this use, and the intent of the specific descriptions and illustrations of the previous figure is not intended to limit application of the magnetic circuit to the particular devices shown. For example, FIGS. 4 and 11 show resonant chambers, although the objects of the invention which create a plurality of beams tunnels with efficient electron transport could also work for amplification of helical wave structures, traveling wave tube structures, or any structure known in the art of microwave devices that could benefit from a multiple beam and multiple beam tunnel magnetic circuit.

As shown in the alternative embodiments, the design conditions which produce a magnetic field for the confined flow of a plurality of radially positioned electron beams are numerous. Many alternative structures could be proposed which satisfy this condition, and the structures given are proposed only for illustration in understanding the present invention. The present RF device may operate as an amplifier, or as an oscillator, or in any way a single beam prior art device may operate. As vehicles for understanding the present invention, it is not intended that the scope of the invention is limited to only the structures shown.

We claim:

1. A multiple beam RF device, said device comprising:

a magnetic field enclosure having a central axis, a cylindrical body oriented along said central axis, a cathode end, and a collector end;

a solenoidal field generator located within said magnetic field enclosure and generating a field substantially aligned with said central axis;

said magnetic field enclosure cathode end and said magnetic field enclosure collector end each having n apertures;

an RF circuit having a plurality said n of beam tunnels, each said beam tunnel having a beam tunnel axis, each said beam tunnel including drift tubes and gaps, said beam tunnel extending from said cathode end aperture to said collector end aperture, said cathode end aperture forming an anode;

a plurality n of thermionic cathodes;

a plurality said n of collectors;

a magnetic field corrector external to said magnetic field enclosure and enclosing each said cathode.

2. The RF device of claim 1 where said RF circuit includes at least 3 gaps.

3. The RF device of claim 2 where said RF circuit includes a first gap proximal to said cathode end.

4. The RF device of claim 3 where said first gap includes an RF input port.

5. The RF device of claim 3 where said first gap is common to all said beam tunnels.

6. The RF device of claim 3 where said first gap forms a resonant chamber at a given RF frequency.

7. The RF device of claim 3 where a second gap is positioned between said first gap and said collector end.

8. The RF device of claim 7 where said second gap includes an RF input port.

9. The RF device of claim 7 where said second gap is common to all said beam tunnels.

10. The RF device of claim 7 where said second gap forms a resonant chamber at said given RF frequency.

11. The RF device of claim 7 where each said beam tunnel includes said second gap forming a cavity, said second gaps not sharing said cavity.

12. The RF device of claim 7 where said second gap forms a resonant cavity at said given RF frequency.

13. The RF device of claim 7 where a third gap is positioned between said second gap and said collector end.

14. The RF device of claim 13 where said third gap includes an RF output port.

15. The RF device of claim 13 where said third gap is common to all said beam tunnels.

16. The RF device of claim 15 where said third gap forms a resonant chamber at said given RF frequency.

17. The RF device of claim 1 where said anode is adjacent to said cathode, and a voltage is applied between said anode and said cathode.

18. The RF device of claim 17 where said anode of said RF circuit is common to all said cathodes.

19. The RF device of claim 17 where said anode end of said RF circuit is separately formed for each said cathode.

20. The RF device of claim 1 where said RF circuit is formed from copper.

21. The RF device of claim 1 where said magnetic field corrector is circularly symmetric with respect to said central axis.

22. The RF device of claim 1 where said magnetic field corrector is formed by a solid of rotation, said solid of rotation formed from a locus of points rotated about said central axis.

23. The RF device of claim 1 where said magnetic field corrector is formed such that flux leaving said magnetic field enclosure cathode end impinges on said cathode perpendicular to the surface of said cathode.

24. The RF device of claim 1 where said magnetic field corrector includes an aperture for each cathode, and said magnetic field corrector is formed from the solid of rotation from rotating a locus of points about a central axis, said locus of points described by:

a first arc segment having a center located on a point planar to said magnetic field enclosure cathode end and at the center of said cathode aperture, said arc starting on said plane of said magnetic field enclosure and ending on said magnetic field correction aperture, a second arc segment having a center located on a point within a first distance of an edge of said cathode, said first distance less than half the diameter of said cathode, said arc segment starting on said plane of said magnetic field enclosure and ending on said magnetic field correction aperture.

25. The RF device of claim 24 where said magnetic field corrector includes a plurality of apertures, one for each said electron gun.

26. The RF device of claim 1 where each said electron gun is centered in each said beam tunnel such that the axis of each said cathode of each said electron gun and the axis of each said beam tunnel are coincident.

27. The RF device of claim 24 where the magnetic field apertures are rotated an angle 21 azimuthally about said central axis, said rotation compensating for any helical trajectory of an electron beam which starts at each said cathode and ends at each said collector.

28. A magnetic circuit for the guiding of a plurality n of parallel electron beams into a plurality n of electron beam tunnels, said magnetic circuit comprising:

a cylindrical magnetic enclosure having a central axis, said enclosure including a cathode end cap and a collector end cap, said magnetic enclosure substantially surrounding said plurality n of electron beam tunnels;

a plurality of electron guns, each said electron gun having a thermionic heater coupled to a cathode having a surface emitting electrons, each said cathode emitting surface positioned proximal to said cathode end cap of said electron beam tunnel, said end cap including an aperture for furnishing electrons into said beam tunnel;

an RF circuit surrounding said beam tunnels;

a magnetic field generator located inside said cylindrical magnetic enclosure for producing a magnetic field parallel to said central axis;

a magnetic field corrector for modifying said magnetic field produced by said magnetic field generator such that said magnetic field is perpendicular to each said cathode electron emitting surface.

29. The magnetic circuit of claim 28 where said magnetic field corrector includes an electromagnetic coil wound around each said cathode and producing a correcting magnetic field.

30. The magnetic circuit of claim 28 where said magnetic field corrector includes a plurality of voids in said cathode end cap.

31. The magnetic circuit of claim 28 where said magnetic field corrector includes a plurality of apertures in said cathode end cap, each said aperture for each said beam tunnel including a first aperture centered on said beam tunnel and a crescent aperture formed by a first circle concentric to said first aperture and a second circle of larger diameter than said first circle, said second circle tangent to said first circle on a point on a line between said first aperture center and said central axis.

32. The magnetic circuit of claim 28 where said magnetic field corrector includes an electromagnetic coil concentric to said central axis and outside the extent of said cathodes.

33. The magnetic circuit of claim 28 where said magnetic field corrector includes a permanent magnet concentric to said central axis and outside the extent of said cathodes.

34. The magnetic circuit of claim 28 where said magnetic field corrector includes an electromagnetic coil concentric to said central axis.

35. The magnetic circuit of claim 28 where said magnetic field corrector includes an iron post concentric to said central axis and an iron disk concentric to said central axis attached to said iron post.

36. The magnetic circuit of claim 28 where said magnetic field corrector includes a solid of rotation which encloses said cathodes.

37. The magnetic field circuit of claim 28 where said magnetic field corrector includes a solid of rotation formed by sweeping a locus of points about said central axis, said locus of points formed by a first arc having a center in front of said cathode, and a second arc having a center a first distance from the outside edge of same said cathode, said first distance less than half the diameter of said cathode.

38. The magnetic circuit of claim 28 where said RF circuit includes a traveling wave electric circuit.

39. The magnetic circuit of claim 38 where said traveling wave electric circuit is common to at least two said beam tunnels.

40. The magnetic circuit of claim 38 where said traveling wave electric circuit is not common to any said beam tunnels.

41. The magnetic circuit of claim 28 where said RF circuit includes a resonant RF circuit.

42. The magnetic circuit of claim 41 where said resonant RF circuit includes a common input port and a common output port.

43. The magnetic circuit of claim 42 where said resonant RF circuit includes at least one common resonant cavity between said input port and said output port.

44. The magnetic circuit of claim 42 where said resonant RF circuit includes no common resonant cavity between said input port and said output port.

45. The magnetic circuit of claim 41 where said resonant RF circuit is a klystron.

* * * * *

UNITED STATES PATENT AND TRADEMARK OFFICE

CERTIFICATE OF CORRECTION

PATENT NO. : 6,768,265 B1 
DATED : July 27, 2004
INVENTOR(S) : Ives, Miram and Krasnykh It is certified that error appears in the above-identified patent and that said Letters Patent is hereby corrected as shown below:

Column 1,
Line 4, add the sentence:
-- This invention was made with Government support under Contract No. DE-FG03-00ER82964 awarded by the Department of Energy. The Government has certain rights in this invention. --

Signed and Sealed this

Twenty-eighth Day of June, 2005

JON W. DUDAS
*Director of the United States Patent and Trademark Office*